US007391389B1

(12) United States Patent
Kawada et al.

(10) Patent No.: US 7,391,389 B1
(45) Date of Patent: Jun. 24, 2008

(54) PLASMA DISPLAY PANEL DEVICE

(75) Inventors: Toyoshi Kawada, Kawasaki (JP); Masami Aoki, Tokyo (JP)

(73) Assignee: Hitachi Limited, Tokyo (JP)

( * ) Notice: Subject to any disclaimer, the term of this patent is extended or adjusted under 35 U.S.C. 154(b) by 0 days.

(21) Appl. No.: 09/468,639

(22) Filed: Dec. 22, 1999

(30) Foreign Application Priority Data

Dec. 28, 1998 (JP) ..... 10-374269

(51) Int. Cl.
*G09G 3/28* (2006.01)

(52) U.S. Cl. ..... 345/60; 345/68

(58) Field of Classification Search ..... 345/60–70, 345/204, 211; 315/169.1, 169.4; 313/581
See application file for complete search history.

(56) References Cited

U.S. PATENT DOCUMENTS

| | | | | |
|---|---|---|---|---|
| 4,044,349 | A | 8/1977 | Andoh et al. | |
| 4,384,287 | A | 5/1983 | Sakuma | |
| 4,652,796 | A | 3/1987 | Delgrange et al. | |
| 5,331,252 | A | 7/1994 | Kim | |
| 5,654,728 | A * | 8/1997 | Kanazawa et al. | 345/68 |
| 6,256,001 | B1 * | 7/2001 | Kim et al. | 345/60 |
| 6,483,487 | B2 * | 11/2002 | Iseki | 345/60 |

FOREIGN PATENT DOCUMENTS

| | | |
|---|---|---|
| EP | 0 068 110 A2 | 1/1983 |
| EP | 0 657 861 | 1/1994 |
| EP | 0 704 834 | 4/1996 |
| EP | 0 810 577 | 8/1996 |
| JP | 6-289811 | 10/1994 |
| JP | 9-22272 | 1/1997 |
| JP | 9-68946 | 3/1997 |

* cited by examiner

*Primary Examiner*—Regina Liang
(74) *Attorney, Agent, or Firm*—Staas & Halsey LLP

(57) ABSTRACT

According to the present invention, drive voltage pulses are applied between a pair of electrodes by driving a first power source having a specific voltage from a state in which the electrodes are maintained at the potential of a reference power source that is different from the potential of the ground power source, and then returning it to the reference power source. As a result, the gas discharge current or capacitance charging and discharging current accompanying the application of the drive voltage pulses is prevented from flowing to the first power source line. The above-mentioned gas discharge current or capacitance charging and discharging current resulting from the application of the drive voltage pulses flows to the first power source or the reference power source electrically separated from the ground power source, and does not flow to the ground power source line, so no noise is generated on the first power source.

10 Claims, 24 Drawing Sheets

Drive Circuit

FIG. 4A Drive Wave Form
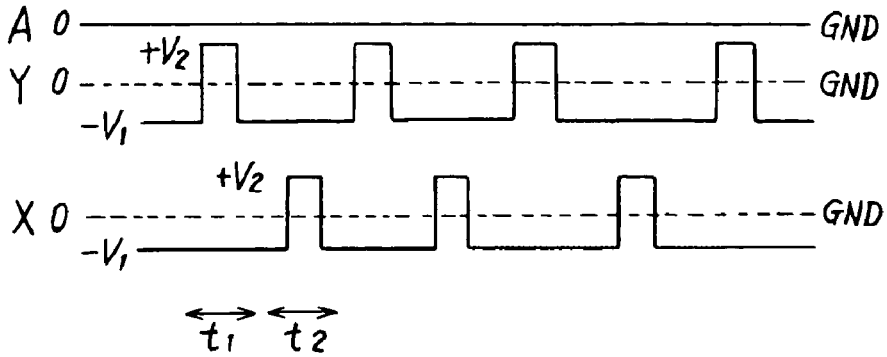
FIG. 4B Drive Circuit
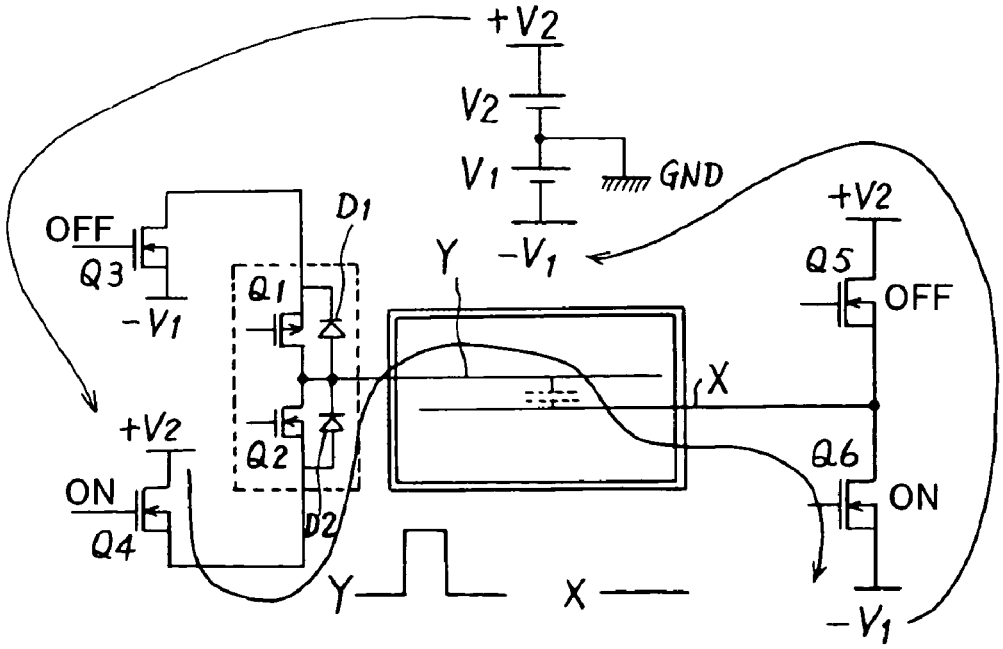

FIG. 5A Drive Wave Form
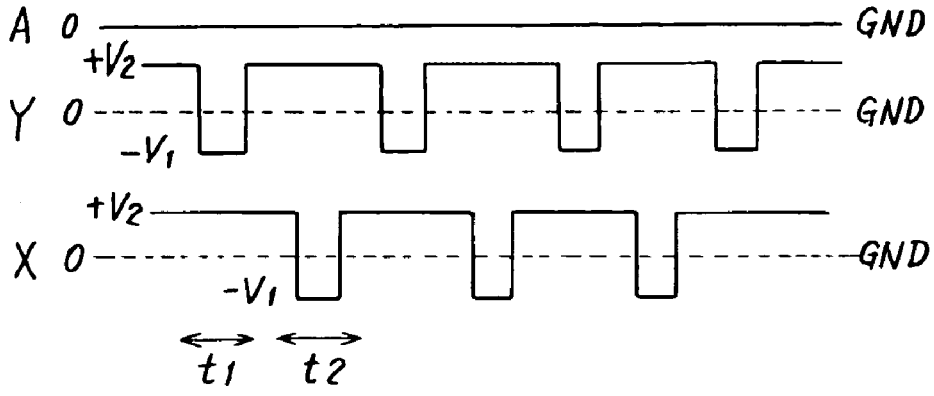
FIG. 5B Drive Circuit
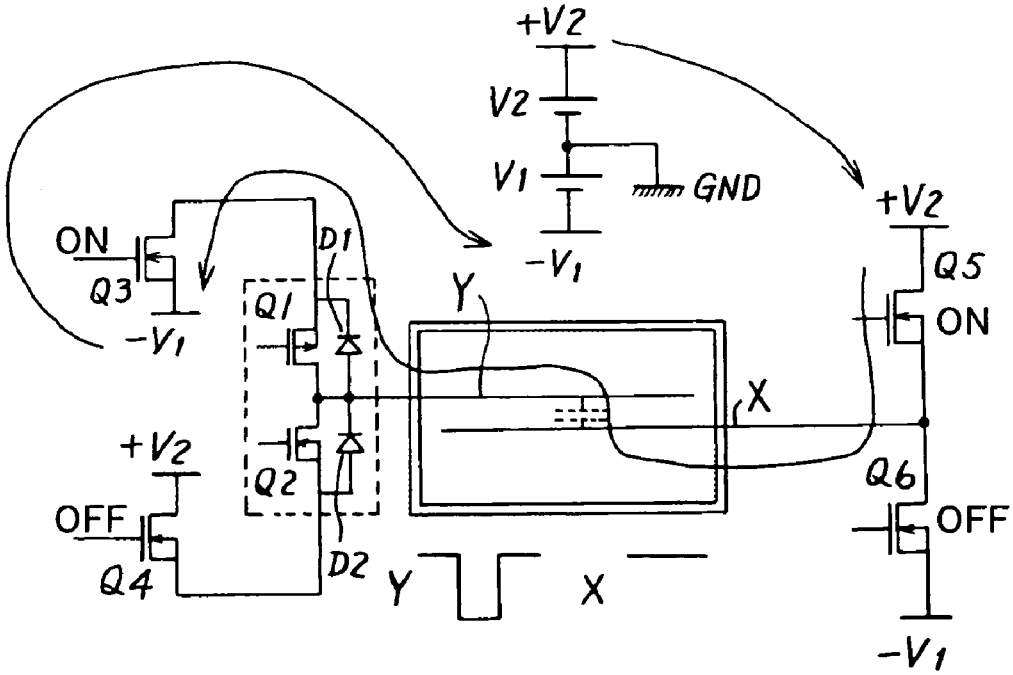

Drive Method (3)
FIG. 6A Drive Wave Form
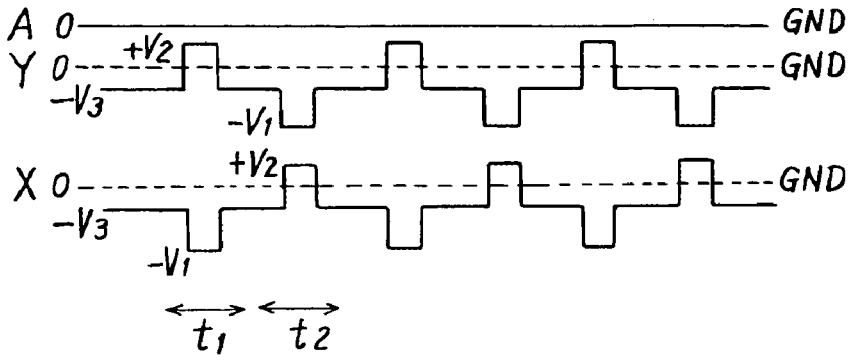
FIG. 6B Drive Circuit
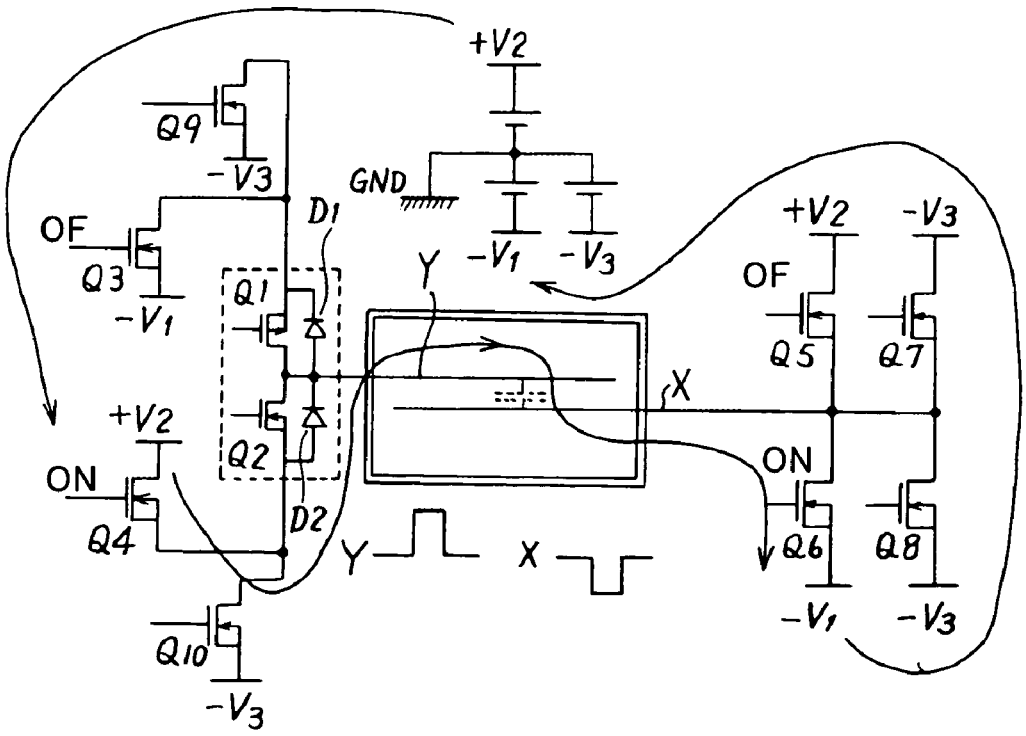

Drive Method (4)
FIG. 7A Drive Wave Form
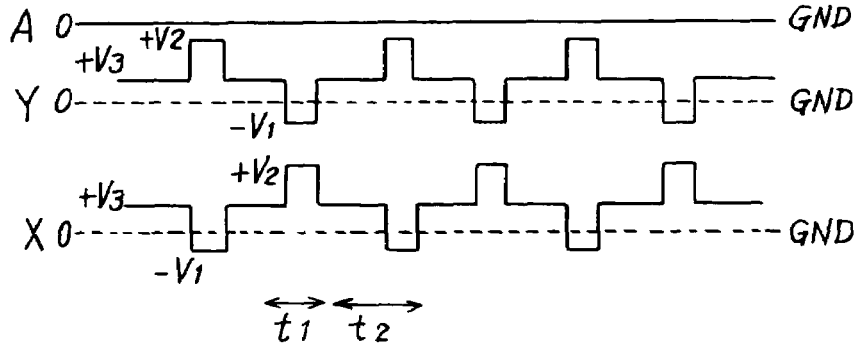
FIG. 7B Drive Circuit
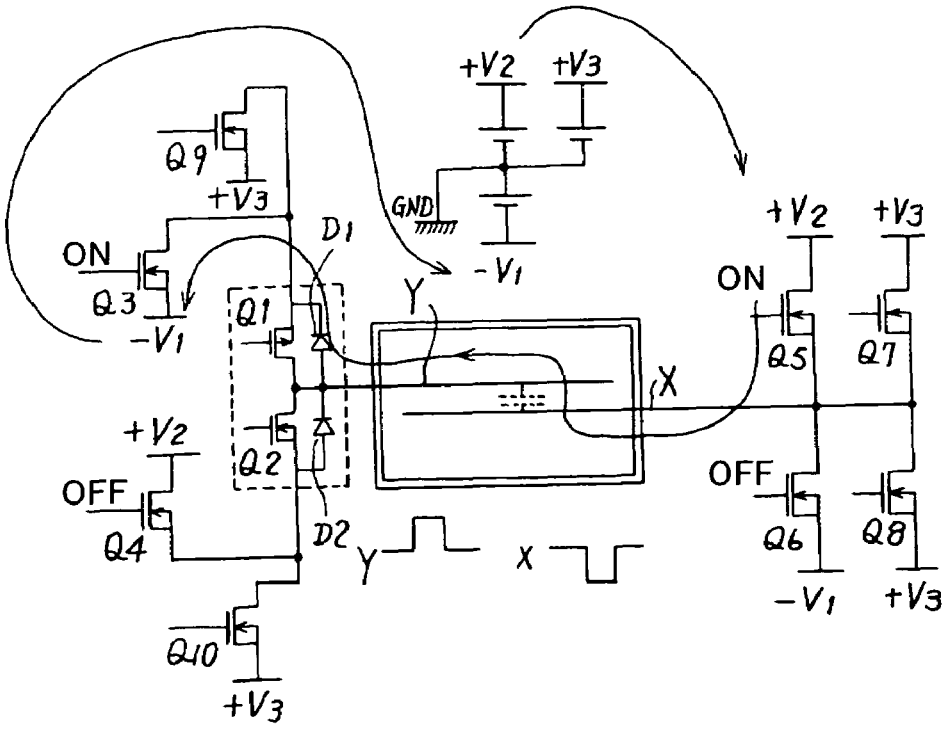

First Embodiment

First Embodiment

Second Embodiment

Second Embodiment

Third Embodiment

Third Embodiment

Fourth Embodiment

Fourth Embodiment

Fifth Embodiment

Fifth Embodiment

Sixth Embodiment

Sixth Embodiment

Seventh Embodiment

Seventh Embodiment

Eighth Embodiment

Eighth Embodiment

Prior Art
FIG. 24A Example 1
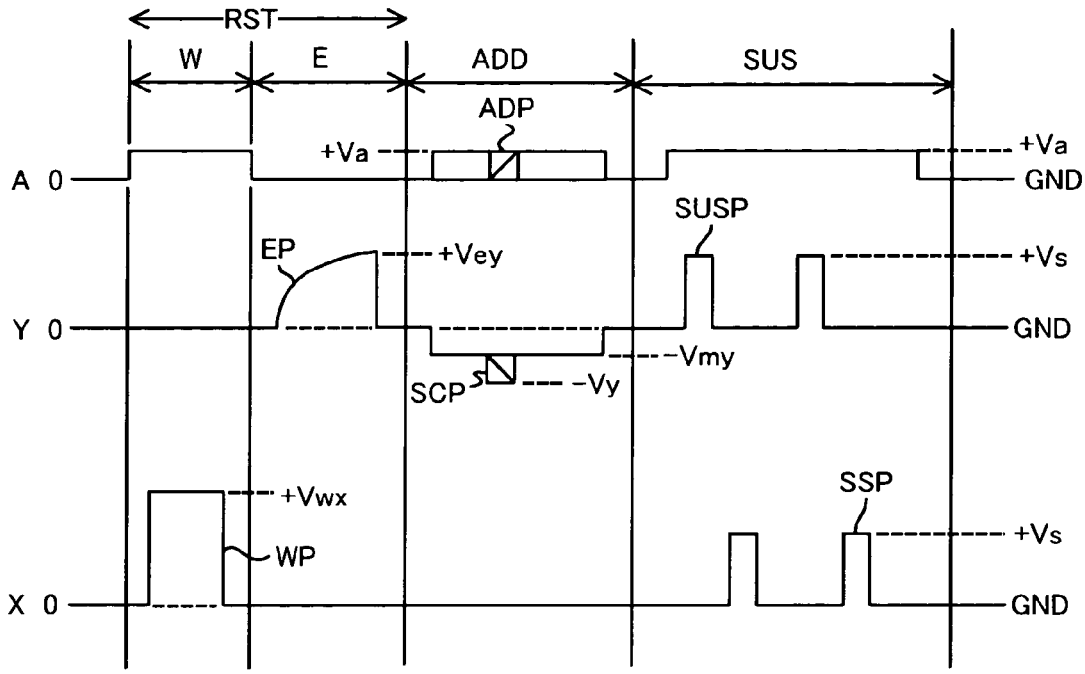
FIG. 24B Example 2
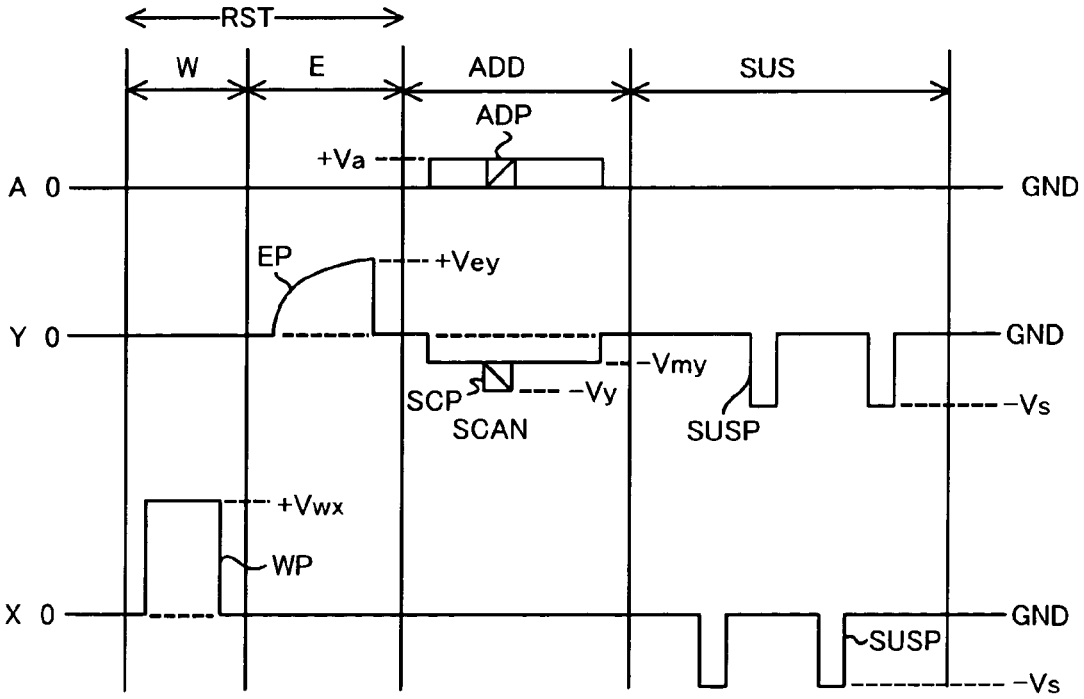

PLASMA DISPLAY PANEL DEVICE

BACKGROUND OF THE INVENTION

1. Field of the Invention

The present invention relates to a plasma display panel device that performs display by utilizing plasma discharge to emit light, and to a method for driving this device, and more particularly relates to a plasma display panel device in which malfunctions are reduced by decreasing the power source noise caused by generation of the discharge current, and to a method for driving this device.

2. Description of the Related Art

Plasma display panel devices (hereinafter referred to as PDP devices) are attracting notice as flat displays that have a large screen and a wide viewing angle. In particular, the three-electrode type of surface discharge AC drive PDP devices which have been developed recently allow full-color displays, and are expected to be very popular in television sets, computer display devices, and so forth.

A PDP device generates a discharge between a pair of electrodes by application of a discharge voltage between the electrodes, and the desired display is achieved through the generation of light from a fluorescent material that accompanies this discharge. In order to apply this discharge voltage, discharge voltage pulses are applied to at least one of the electrodes. The application of discharge voltage pulses is accompanied by the application of a high voltage between the electrodes, which generates a discharge, and excess discharge current flows from one of the electrodes toward the other electrode during the generation of this discharge.

FIG. 24 is a diagram illustrating the drive waveform of a conventional three-electrode surface discharge AC-PDP device. FIG. 24A illustrates a first example, and FIG. 24B a second example. A three-electrode surface discharge AC-PDP device has an address electrode A on one substrate, and has on another substrate an X electrode and a Y electrode disposed perpendicular to the address electrode. The drive method is as shown in simplified fashion in the figure, and comprises a reset period RST in which full writing W and full erasure E are performed, an address period ADD in which discharge is performed selectively according to the display data, and a sustaining discharge period SUS in which sustaining discharge is performed for an illuminated cell in the address period.

In both examples, the reference potential of the various electrodes is the ground potential, and when voltage pulses are applied, the specified voltage is applied from the ground potential, and the potential returns to its original ground level after a specific period of time. In the reset period, the Y electrodes are kept at the ground potential while high-voltage write pulses WP are applied to all of the X electrodes. The application of these write pulses WP causes all of the cells to light up and enter more or less the same state. After this, the X electrodes are kept at the ground potential while erase pulses EP are applied to all of the Y electrodes, so that all of the cells are lighted and then erased. As a result, no wall charges are stored in any of the cells.

In the subsequent address period ADD, negative scan pulses SCP are successively applied to the Y electrodes, and address pulses ADP are selectively applied to the address electrodes according to the display data in synchronization with the above-mentioned SCP application. As a result, the combined voltage of the two pulses SCP and ADP is applied between the address electrodes and the Y electrodes, generating an address discharge. Wall charges are stored in the lighted cells as a result of this. Then, in the sustaining discharge period, sustaining discharge pulses SUSP are applied alternately to the X electrodes and Y electrodes, which generates sustaining discharges a plurality of times for the above-mentioned cells in which walls charges are stored. The brightness of the cells is controlled by the number of these sustaining discharges. In example 1 in FIG. 24A, the sustaining pulses SUSP are positive voltage pulses, whereas in example 2 in FIG. 24B, the sustaining pulses SUSP are negative voltage pulses.

As mentioned above, in the sustaining discharge period, sustaining voltage pulses SUSP are alternately applied between the X electrodes and Y electrodes serving as the display electrodes. With a conventional drive method, the application of the sustaining voltage pulses SUSP maintains the X electrodes or Y electrodes at the ground potential, which is the reference potential, the potential is driven from this ground potential to the sustaining discharge voltage, that is, to the level of a positive voltage +Vs or the level of a negative voltage −Vs, and upon completion of the pulse period, the potential is returned to the ground potential level. When this sustaining discharge voltage is applied, excess discharge current flows between the X and Y electrodes, and the path thereof is a loop going from the sustaining discharge voltage power source of voltage +Vs or −Vs, to a switch circuit on the source side, one of the electrodes, a discharge space, the other electrode, a switch circuit on the sink side, and then the ground power source, and finally returning to the ground terminal of the sustaining discharge voltage power source.

This sustaining voltage pulses Vs are high-voltage, high-speed pulses with a voltage of approximately 200 V and a rise time of just a few hundred nanoseconds, and a peaked discharge current instantly flows as soon as the pulses are applied. Such a peak current is called a panel capacitance charging and discharging current, or a gas discharge current. When this large peaked current flows to the ground power source line, the voltage thereof is lowered by the impedance component had by the ground power source line, and a noise component, namely, a fluctuation in the ground potential, is generated. This noise component of the ground potential can become admixed in surrounding control circuits, disrupt the waveform of the control signals, and lead to malfunction. Or, even if a malfunction does not occur, distortion can occur not only in the control signals but also in the drive waveform itself, leading to the generation of a high-frequency component. The generation of a high-frequency component is a cause of electromagnetic wave noise being radiated to the surrounding area, and is also a cause of interference with external electrical devices.

These problems similarly occur in the application of write pulses between the X electrodes and Y electrodes in the reset period. Gas discharge current is generated during rise when the write pulses WP are applied, and a charging and discharging current is generated during fall at the completion of the application of the write pulses WP.

A separate problem is that when sustaining pulses SUSP of positive polarity are applied to the X and Y electrodes, if the address electrode A is maintained at the ground potential, then the address electrode side will have negative polarity, and a positive charge will be stored on the surface of the address electrode. This stored charge has a polarity that is added to the address voltage during the address period, so an excessively large address discharge is generated, which can lead to excess discharge to adjacent cells. This excess discharge is a cause of variance. Furthermore, if the address electrode side has an extremely negative voltage with respect to the X and Y electrodes, positive charges may collide with the fluorescent material provided on the address electrode, shortening the service life of the fluorescent material.

To solve such problems, as shown in FIG. 24A, it has been proposed that an intermediate voltage of Va be applied to the address electrode during the sustaining discharge period. In this case, however, if spiked noise is superimposed on the output side of the drive circuit of the address electrode as a result of capacity coupling or the like accompanying the application of the sustaining pulses, then the potential thereof will be at a level that is higher than the power source voltage level, there will be no margin with respect to the withstand voltage of the drive circuit, and adequate reliability cannot be ensured.

SUMMARY OF THE INVENTION

In view of this, it is an object of the present invention to provide a plasma display panel device in which noise is prevented from being generated at the ground power source when sustaining pulses, write pulses, or other such discharge voltage pulses are applied, as well as a method for driving this device.

To achieve at least one of the stated objects, in accordance with the present invention, drive voltage pulses, i.e., discharge voltage pulses, are applied between a pair of electrodes by driving a first power source having a specific voltage from a state in which the electrodes are maintained at the potential of a reference power source that is different from the potential of a ground power source, and then returning it to the reference power source. As a result, the gas discharge current or capacitance charging and discharging current accompanying the application of the drive voltage pulses is prevented from flowing to the first power source line. The above-mentioned gas discharge current or capacitance charging and discharging current resulting from the application of the drive voltage pulses flows to the first power source or the reference power source electrically separated from the ground power source, and does not flow to the ground power source line, so no noise is generated on the first power source.

BRIEF DESCRIPTION OF THE DRAWINGS

FIG. 4 is a diagram illustrating the first drive method in this embodiment;

FIG. 5 is a diagram illustrating the second drive method in this embodiment;

FIG. 6 is a diagram illustrating the third drive method in this embodiment;

FIG. 7 is a diagram illustrating the fourth drive method in this embodiment;

FIG. 24 is a diagram illustrating the drive waveform of a conventional PDP.

DESCRIPTION OF THE PREFERRED EMBODIMENTS

Embodiments of the present invention will now be described through reference to the figures. These embodiments do not, however, limit the technological scope of the present invention. A three-electrode surface discharge AC-type PDP device will be used as an example in the following description of the embodiments, but the present invention can be applied to PDP devices with a variety of structures. Further, a discharge voltage pulse is one example of a drive voltage pulse in the following embodiment.

Figure 1:
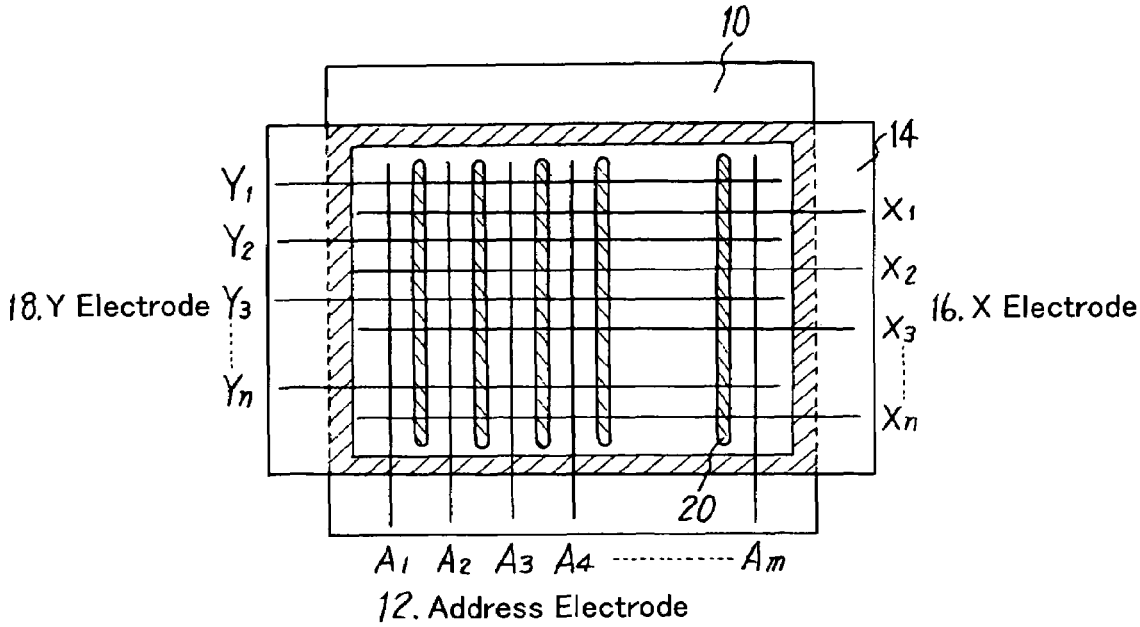
FIG. 1 is a plan view of a three-electrode surface discharge AC type of PDP device in an embodiment.

FIG. 1 is a plan view of a three-electrode surface discharge AC type of PDP device in an embodiment. The PDP shown in FIG. 1 is provided with a plurality of address electrodes 12 arranged perpendicular to a back glass substrate 10. Ribs 20 are provided between the address electrodes 12, and X electrodes 16 and Y electrodes 18 are provided to a front glass substrate 14 such that they are alternately laid out horizontally. The X electrodes 16 are usually such that a plurality of electrodes are connected in common and driven by a common X driver, which is discussed below. The Y electrodes function as scanning electrodes to which scanning pulses are successively applied during the address period, and also function as display electrodes or sustaining electrodes to which sustaining discharge pulses (drive pulses) are applied in common during the sustaining discharge period.

Figure 2:
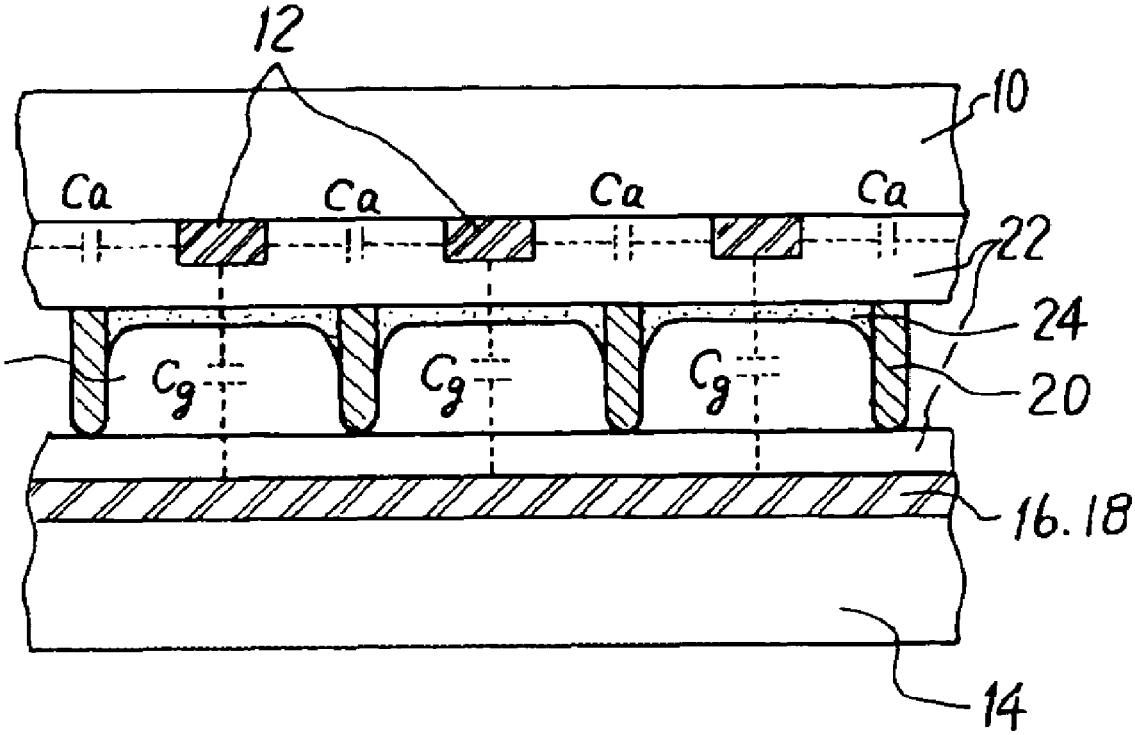
FIG. 2 is a cross section of the PDP in FIG. 1.

FIG. 2 is a cross section of the PDP in FIG. 1. FIG. 2 shows the cross sectional structure along the X electrodes or Y electrodes. The address electrodes 12 are provided on the back glass substrate 10, over which are provided a dielectric layer 22 and partitions (ribs) 20. A fluorescent material 24 is provided over the dielectric layer 22 and between the ribs 20. The front glass substrate 14 is provided with a discharge space between it and the back glass substrate 10. The X electrodes 16 and Y electrodes 18 are provided over the front glass substrate 14, and over these are provided another dielectric layer 22. As shown in FIG. 2, an opposing electrode capacitance Cg is parasitically formed between the address electrodes 12 and the Y electrodes 18, and an adjacent electrode capacitance Ca is parasitically formed between the X electrodes 16 and the Y electrodes 18 as well.

Figure 3:
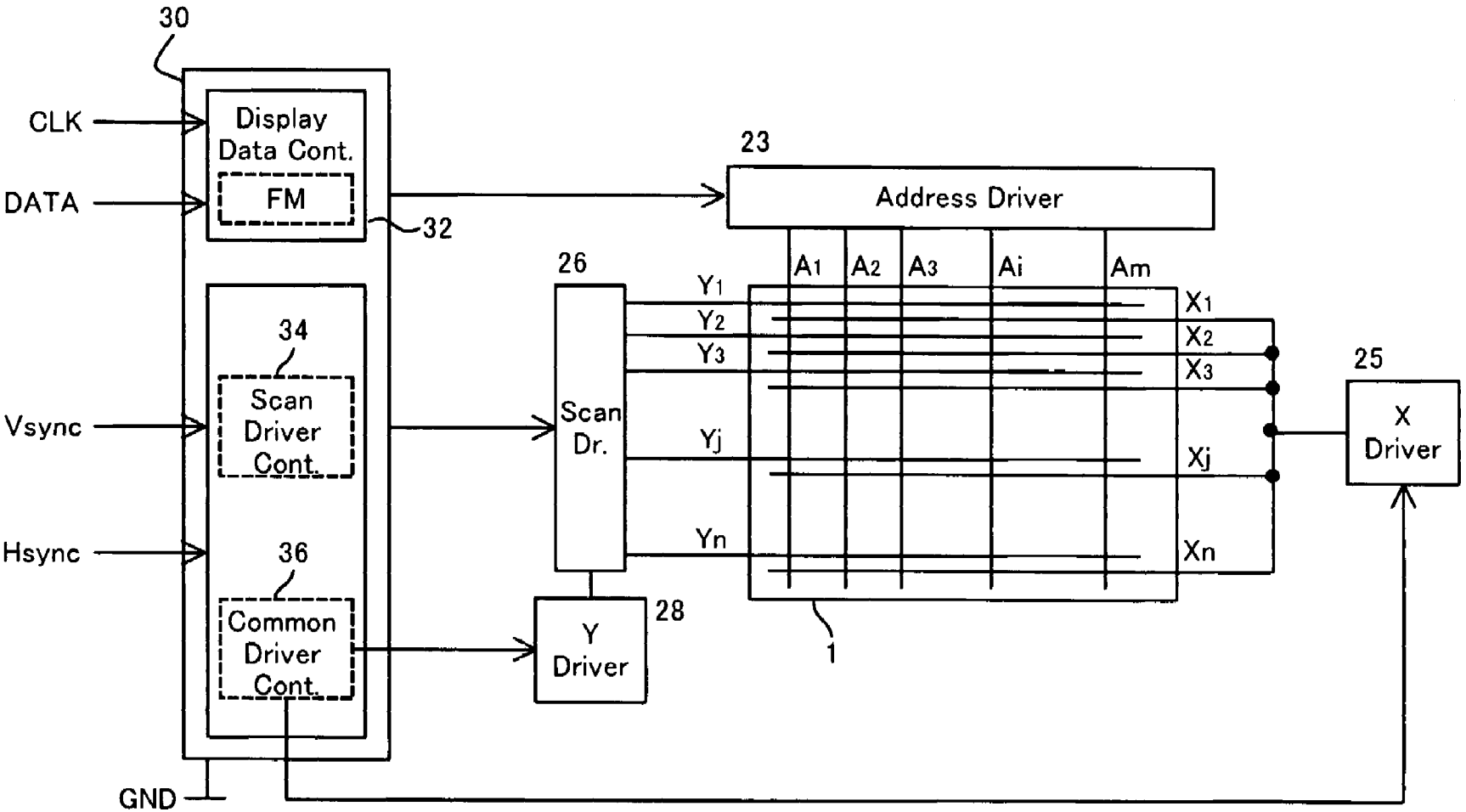
FIG. 3 is a block diagram of the drive circuit in the PDP in FIGS. 1 and 2.

FIG. 3 is a block diagram of the drive circuit in the PDP in FIGS. 1 and 2. The address electrodes provided to the panel 1 are driven by an address driver 23, the X electrodes are driven by a common X electrode driver 25, and the Y electrodes are driven by a scanning driver 26 during the address period, and by a common Y electrode driver 28 during the sustaining discharge period. Each driver is supplied with control signals from a control circuit 30 so as to control the drive operations thereof. The control circuit 30 utilizes a ground power source GND for a reference voltage to produce the various control signals.

The control circuit 30 has a display data control portion 32, a scanning driver control portion 34, a common driver control portion 36, and so on, and is supplied with clock pulses CLK, display data DATA, vertical synchronization signals Vsync, horizontal synchronization signals Hsync, and so on from a computer, a tuner, or the like. The display data control portion 32 receives the display data DATA and performs the required A/D conversion, intensity level adjustment, data conversion, and so forth, and supplies data signals for display to the address driver 23. The scanning driver control portion 34 supplies scanning control signals to the scanning driver 26 in synchronization with the synchronization signals. The common driver control portion 36 produces control signals for the application of write pulses or erase pulses during the reset period and for the application of sustaining pulses during the sustaining discharge period, and supplies these control signals to the drivers 25 and 28.

FIGS. 4A and 4B illustrate the first drive method in this embodiment. This is an example of sustaining pulses applied between the X electrodes and Y electrodes. FIG. 4A illustrates the drive waveforms of the address electrodes A and the X and Y electrodes, and FIG. 4B illustrates the path of the discharge current and the drive circuit of the X and Y electrodes. With the first drive method in FIGS. 4A and 4B, the X and Y electrodes are both maintained at a negative first power source potential −V1 that is different from the ground power source GND, and are alternately driven to a positive second power source potential +V2 and then returned to the first power source potential −V1. To this end, power sources V2 and V1, which use the ground power source GND as a reference, are provided in the drive circuit, and the first power source potential V1 and the second power source +V2 constitute a power source line that is electrically separate from the ground power source line GND.

The drive circuit of the X electrodes comprises of N channel transistors Q5 and Q6, and these transistors are supplied with control signals from the common driver control portion 36. The X electrodes are connected to the first power source −V1 via the transistor Q6, and to the second power source +V2 via the transistor Q5. The drive circuit of the Y electrodes is provided with a P channel transistor Q1, an N channel transistor Q2, and diodes D1 and D2 for each Y electrode as a scanning driver circuit, and is provided with N channel transistors Q3 and Q4 as a common Y driver. These transistors Q1 and Q2 and diodes D1 and D2 are similarly connected for all of the Y electrodes. The transistors Q1 and Q2 are supplied with scanning scan pulses SCPs from the scanning driver control portion 34, and perform an operation whereby scanning pulses are applied to each Y electrode. The transistors Q3 and Q4 are supplied with control signals from the common driver control portion 36, and during sustaining discharge there is a connection to the first power source −V1 via the diode D1 and the transistor Q3, and a connection to the second power source +V2 via the diode D2 and the transistor Q4.

As shown in FIG. 4A, during the period t1 the transistors Q3 and Q6 are conductive and the X and Y electrodes are maintained at the potential of the first power source −V1 in order to perform sustaining discharge. (More accurately, the Y electrodes are maintained at a higher potential than the first power source −V1 by an amount equal to the forward voltage of the diode D1.) The transistor Q3 is then turned off and the transistor Q4 turned on, which connects the Y electrodes to the second power source +V2 and applies a discharge pulse. After the pulse period, the transistor Q4 is turned off and the transistor Q3 turned on, and the Y electrodes are once again connected to the first power source −V1.

Therefore, when drive pulses have been applied to the Y electrodes in the period t1, the discharge current flows along the path shown in FIG. 4B, comprising the second power source +V2, the transistor Q4, the diode D2, the Y electrodes, the discharge cells, the X electrodes, the transistor Q6, and the first power source −V1. Therefore, an excessively large discharge current does not flow to the ground power source line GND.

Furthermore, current flows between the electrodes via the first power source −V1 during the fall of the pulses upon completion of the application of the drive pulses. Here again, no current flows to the ground power source line GND.

In period t2, this time the drive pulses are applied on the X electrode side, in which case the discharge current flows along the path opposite to the path shown in FIG. 4B, comprising the second power source +V2, the transistor Q5, the X electrodes, the discharge cells, the Y electrodes, the diode D1, the transistor Q3, and the first power source −V1. Here again, no excessively large current flows to the ground power source GND.

Therefore, no noise is generated by a large current at the ground power source GND, no malfunction occurs in the control circuit 30 which utilizes the ground power source as a reference power source, and there is no disruption of the control signals generated by control circuit.

Furthermore, the address electrodes are maintained at the ground potential when the sustaining pulses are applied. The sustaining pulses are applied by raising the potential of the X and Y electrodes from the potential of the first power source −V1, which is lower than the ground potential, to the potential of the second power source +V2, which is higher than the ground potential, and then returning this potential to that of the first power source −V1. Therefore, only a voltage that is more or less intermediate is applied as the voltage of the sustaining pulses between the address electrodes maintained at the ground potential and the X and Y electrodes. Accordingly, during the application of sustaining pulses, it is possible to prevent the potential of the address electrodes from being too low and excessive positive charges from being stored or colliding forcefully.

FIG. 5 is a diagram illustrating the second drive method in this embodiment. The drive circuit in FIG. 5B has the same structure as that in FIG. 4B. FIG. 5 is an example of applying sustaining pulses of reverse polarity of FIG. 4. Specifically, as shown by the drive waveforms in FIG. 5A, the X and Y electrodes are connected to the positive power source +V2, which is higher in potential than the ground potential GND, is driven to the potential of the negative power source −V1, which is lower than the ground potential, and is then returned to the potential of the positive power source +V2. Therefore, in the period t1, when a negative drive pulse has been applied to the Y electrodes, the discharge current flows along the path shown in FIG. 5B, comprising the positive power source +V2, transistor Q5, the X electrodes, the discharge cells, the Y electrodes, the diode D1, the transistor Q3, and the negative power source −V1. Specifically, no discharge current flows to the ground power source line GND, nor is any noise generated. In the period t2, negative drive pulses are applied on the X electrode side, so the discharge current flows along the path shown in FIG. 4B, and no discharge current goes into the ground power source GND.

Again in the case of FIG. 5, when drive pulses have been applied, the address electrodes are maintained at the ground potential, so a large electric field is not applied between the address electrodes and the X and Y electrodes, and negative charges are prevented from colliding or being stored on the address electrode side. In particular, the potential of the address electrodes is lower than that of the X and Y electrodes, so positive charges are prevented from colliding with the fluorescent layer.

FIG. 6 is a diagram illustrating the third drive method in this embodiment. In this example, drive pulses of reverse polarity are simultaneously applied to the X electrodes and Y electrodes, and applying this combined voltage between the X and Y electrodes generates a discharge. In this case, the X and Y electrodes are both driven to the potential of the power sources −V3, +V2, and −V1 separate from that of the ground power source GND, so no discharge current flows to the ground power source GND.

As shown by the drive waveforms in FIG. 6A, the X and Y electrodes are initially maintained at the potential of the negative power source −V3. In period t1, the Y electrodes are driven to the potential of the positive power source +V2, and at the same time, the X electrodes are driven to the potential of the negative power source −V1. The combination of these two drive pulses results in the application of the drive pulses shown in FIGS. 4 and 5 between the X and Y electrodes. Upon completion of the pulse application, the X and Y electrodes are returned to the potential of the power source −V3. In period t2, drive pulses with polarity reversed from that given above are applied to the electrodes from the negative power source −V3, which applies a voltage between the electrodes in the opposite direction from that in period t1 and generates a discharge. Here again, the electrodes absorb discharge current supplied from a power source having a different potential from that of the ground potential, so no noise is generated at the ground power source.

The drive circuit is shown in FIG. 6B. In order to perform the third drive method, the power source −V3 is added to this drive circuit in addition to the drive circuits of FIG. 4B and FIG. 5B, and transistors Q7, Q8, Q9, and Q10 are also added. These transistors constitute the common electrode drivers 24 and 28 of the respective electrodes, and are supplied with control signals from the corresponding common driver control portion 36.

With this drive circuit, in period t1, first the transistors Q9, Q10, Q7, and Q8 are conductive to maintain the X and Y electrodes at the potential of the power source −V3. The transistor Q6 is then conductive to connect the X electrodes to the power source −V1, and the transistor Q4 is conductive to connect the Y electrodes to the power source +V2 via the transistor Q4 and the diode D2. As a result, as shown in the figure, the discharge current flows through a path comprising the power source +V2, the transistor Q4, the diode D2, the Y electrodes, the discharge cells, the X electrodes, the transistor Q6, and the power source −V1. Next, the transistors Q9, Q10, Q7, and Q8 are conductive to return the X and Y electrodes to the potential of the power source −V3. At this point, the parasitic capacity between the two electrodes is short-circuited, but this short-circuit current also only flows to the power source −V3. As above, in period t1, even if discharge pulses of reserve polarity are applied to the two electrodes, this will not be accompanied by the generation of noise at the ground power source.

In period t2, the operation is just carried out in completely the opposite polarity as above, and no discharge current or short-circuit current goes into the ground power source, and no noise is generated.

With the third method discussed above, voltage changes in the rise and fall of the discharge pulses applied to the X and Y electrodes can be kept smaller than in the first and second methods. As a result, the drive of the various electrodes is easier, and the generation of higher harmonics that accompanies this drive can be reduced.

FIG. 7 is a diagram illustrating the fourth drive method in this embodiment. Again in this example, just as in the third drive method, discharge pulses of reverse polarity are applied simultaneously to the X electrodes and Y electrodes, and a discharge is generated by applying the combined voltage thereof between the X and Y electrodes. With the fourth drive method, however, both electrodes are maintained at a state of being at the reference potential of the positive power source +V3, then the Y electrodes are driven to the potential of the positive power source +V2, which is higher than the potential of the positive power source +V3, and the X electrodes are driven to the potential of the negative power source −V1 and then both returned to the reference potential +V3. As a result, discharge pulses of reverse polarity are applied to both electrodes, and their combined voltage is applied between the two electrodes.

The drive circuit in FIG. 7B is basically the same as that in FIG. 6B. In the state in which drive pulses have been applied in period t1, the discharge current flows through the path shown in the figure, comprising the power source +V2, transistor Q5, the X electrodes, the discharge cells, the Y electrodes, the diode D1, the transistor Q3, and the power source −V1. Accordingly, no discharge current flows to the ground power source GND, and no noise is generated. Even after the completion of the discharge pulses, since the two electrodes are not connected to the ground power source GND, no short-circuit current flows the ground power source.

Again in the third and fourth drive methods, since the address electrodes are kept at the ground potential, the potential between the address electrodes and the X electrodes and Y electrodes is smaller, making it possible to minimize the problems of wall charge storage on the address electrodes and the collision of positive charges.

Specific embodiments of the drive of a PDP utilizing the four types of drive method given above will now be described.

First Embodiment

Figure 8:
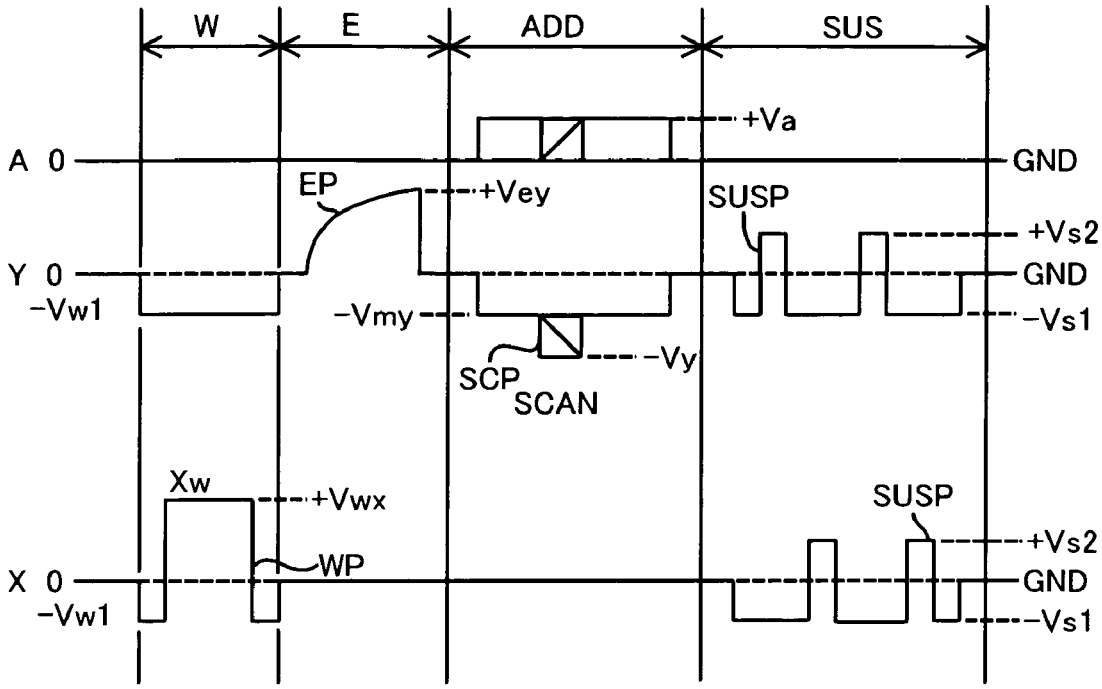
FIG. 8 is a diagram illustrating the drive waveform in the first embodiment.
Figure 9:
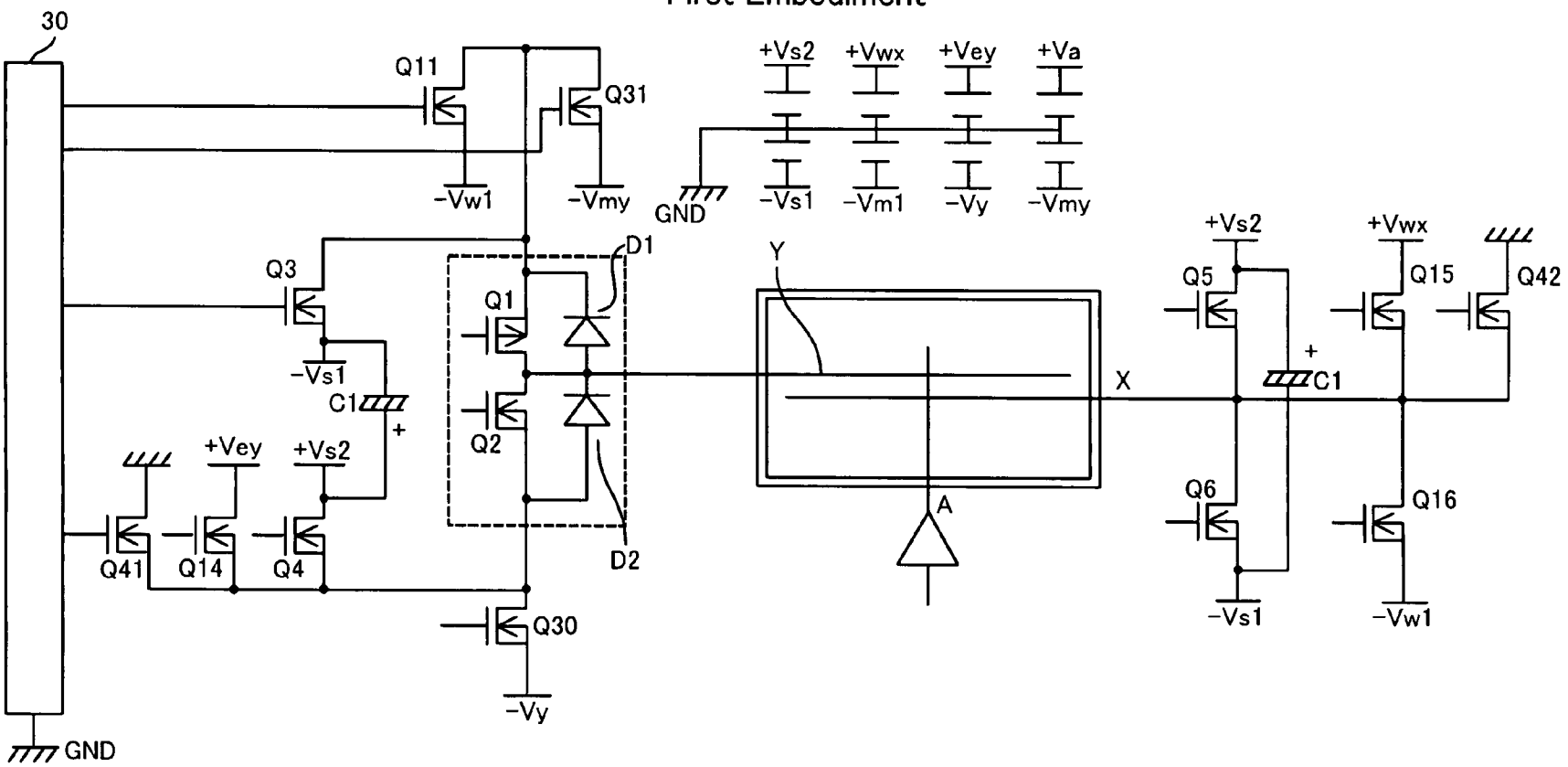
FIG. 9 is a diagram illustrating the drive circuit in the first embodiment.

FIG. 8 is a diagram illustrating the drive waveform in the first embodiment, while FIG. 9 is a diagram illustrating the drive circuit in the first embodiment. This embodiment illustrates the constitution of the drive waveforms and drive circuit applied to a three-electrode type of surface discharge AC-PDP. As shown by the drive waveforms in FIG. 8, the drive waveforms of the X and Y electrodes in the sustaining discharge period SUS and the drive waveforms of the two electrodes in the full-write period W are similar to the drive waveforms in the first drive method discussed above. The drive circuit utilizes the transistors Q1 and Q2 in the scanning drive of the Y electrodes in the address period, at which time the diodes D1 and D2 are both reverse biased. The rest of the transistors are controlled by the common drive control portion in the full-write and sustaining discharge periods.

In this embodiment, the method for applying sustaining voltage pulses to the display electrodes of the Y electrodes and X electrodes, which are laid out in parallel on the front side, is to form sustaining voltage pulses SUSP between the two power source voltages of the power sources—Vs1 and +Vs2, and apply these to the Y and X electrodes. After the address period ADD is finished, the voltage levels for the Y electrodes, the X electrodes, and the address electrodes are first set to the ground potential GND by transistors Q41 and Q42, after which the sustaining period SUS is commenced. Along with the start of the sustaining period SUS, the voltage levels of both the Y electrodes and the X electrodes are dropped to the power source −Vs1 level, this is set as the reference voltage, and the voltage level of the address electrodes is maintained as the state of the ground potential GND. Between the Y and X sustaining electrodes, sustaining voltage pulses SUSP of the level of the power source +Vs2 are applied first to the Y electrodes from the reference voltage of the power source −Vs1, which generates a sustaining discharge between the X electrodes and Y electrodes and generates discharge illumination, and at the same time, a peaked gas discharge current flows. The discharge current here has been raised to a high potential level on the Y electrode side, so it flows from the supply power source of the power source +Vs2 to the power source −Vs1, going through a switching element Q4 on the Y electrode side, the Y electrodes, the discharge cells, and the X electrodes, and then through a switching element Q6 on the X electrode side. At this point, the ground terminal side GND of the two power sources +Vs2 and −Vs1 is point-grounded, or is connected to the ground power source GND at close range, which keeps the discharge current from flowing through the ground power source line GND, and therefore the generation of noise that would disrupt the potential of the ground power source GND is prevented.

Also, a large-capacity capacitor such as an electrolytic capacitor that supplies a charge is usually connected along the wiring path from the power source output to the switching element in order to prevent a voltage drop during the supply of peak current and to compensate the voltage level. As shown in FIG. 9, with this embodiment, this capacitor C1 is directly connected between the power source +Vs2 and the power source −Vs1, but is not connected to the ground power source line GND. Doing this prevents the gas discharge current from flowing to the ground power source line GND. After the flow of gas discharge current is finished, the potential on the Y electrode side is returned to the potential of the power source −Vs1, which concludes the application of the sustaining voltage pulses SUSP to the Y electrode side. Here again, the short-circuit current flowing between the two electrodes does not flow through the ground power source line, and only flows to the reference power source −Vs1.

The sustaining voltage pulses SUSP are similarly applied to the X electrode side in the following timing, but the gas discharge current here just reverses its direction within the panel, and otherwise exactly the same effect is obtained.

With this embodiment, the potential of the address electrode is maintained at the ground potential GND while the above-mentioned sustaining voltage pulses are being continuously applied alternately to the X and Y electrodes. Therefore, the difference in potential between the address electrodes and the sustaining electrodes X and Y is the difference between the ground potential GND and the potential of the power source +Vs2 or the power source −Vs1, and if the absolute value of the power source +Vs2 or −Vs1 is set to be equal, then the potential difference will be cut by half compared to a conventional method, excessive storage of charges on the address electrode can be prevented, and it will be possible to ameliorate malfunctions such as erroneous discharge.

Next, with this embodiment, the same drive method can also be applied to the full-write pulses WP used to periodically activate the display cells over the entire panel. Specifically, at the same time the full-write period W is entered, the reference voltage −Vw1 is applied all at once to the Y electrodes and X electrodes to lower the potential thereof to the ground potential. The potential of the power source +Vwx is then applied to the X electrode side from this reference voltage −Vw1, which generates a full-write discharge. The current resulting from this full-write discharge flows within the drive circuit in FIG. 9 along the path comprising the switching element Q15 on the X electrode side on the supply power source side of the power source +Vwx, the X electrodes, the discharge cells, and the Y electrodes, and then through the switching elements D1 and Q11 on the Y electrode side to the reference power source −Vw1. At this point, the ground terminal side of the two power sources +Vwx and −Vw1 is point-grounded, or is connected to the ground power source GND at close range, which keeps the discharge current from flowing through the ground power source line GND. Therefore, there is no generation of noise that would disrupt ground potential GND. At the conclusion of the full-write period, the Y electrodes and X electrodes both return to the potential of the ground power source GND, and the potential difference between all of the electrodes is reset to zero.

In the full-erase period, a flat-wave pulse of the voltage +Vey level is applied from the Y electrode side, this being applied by actuating the switching element Q14 on the Y electrode side, and a flat waveform is obtained by a method in which a transistor Q14 with a higher on-resistance is used, or in which a resistor (not shown) is inserted in series on the output side of the transistor Q14.

Second Embodiment

Figure 10:
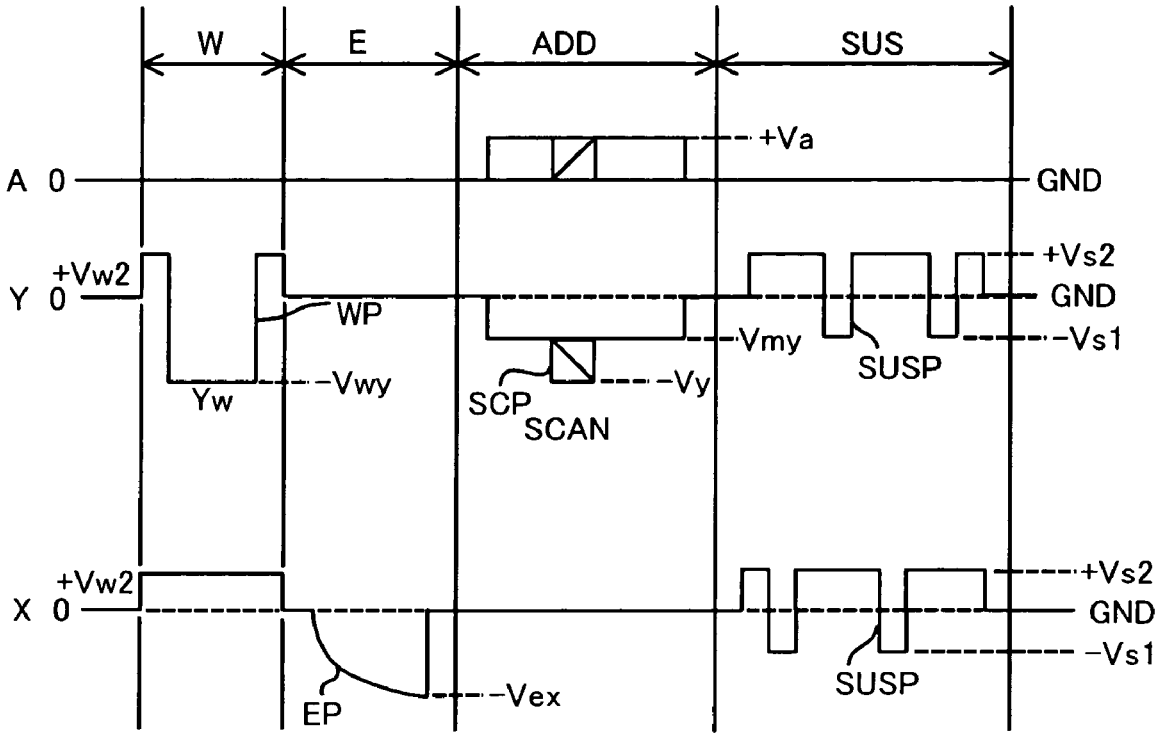
FIG. 10 is a diagram illustrating the drive waveform in the second embodiment.
Figure 11:
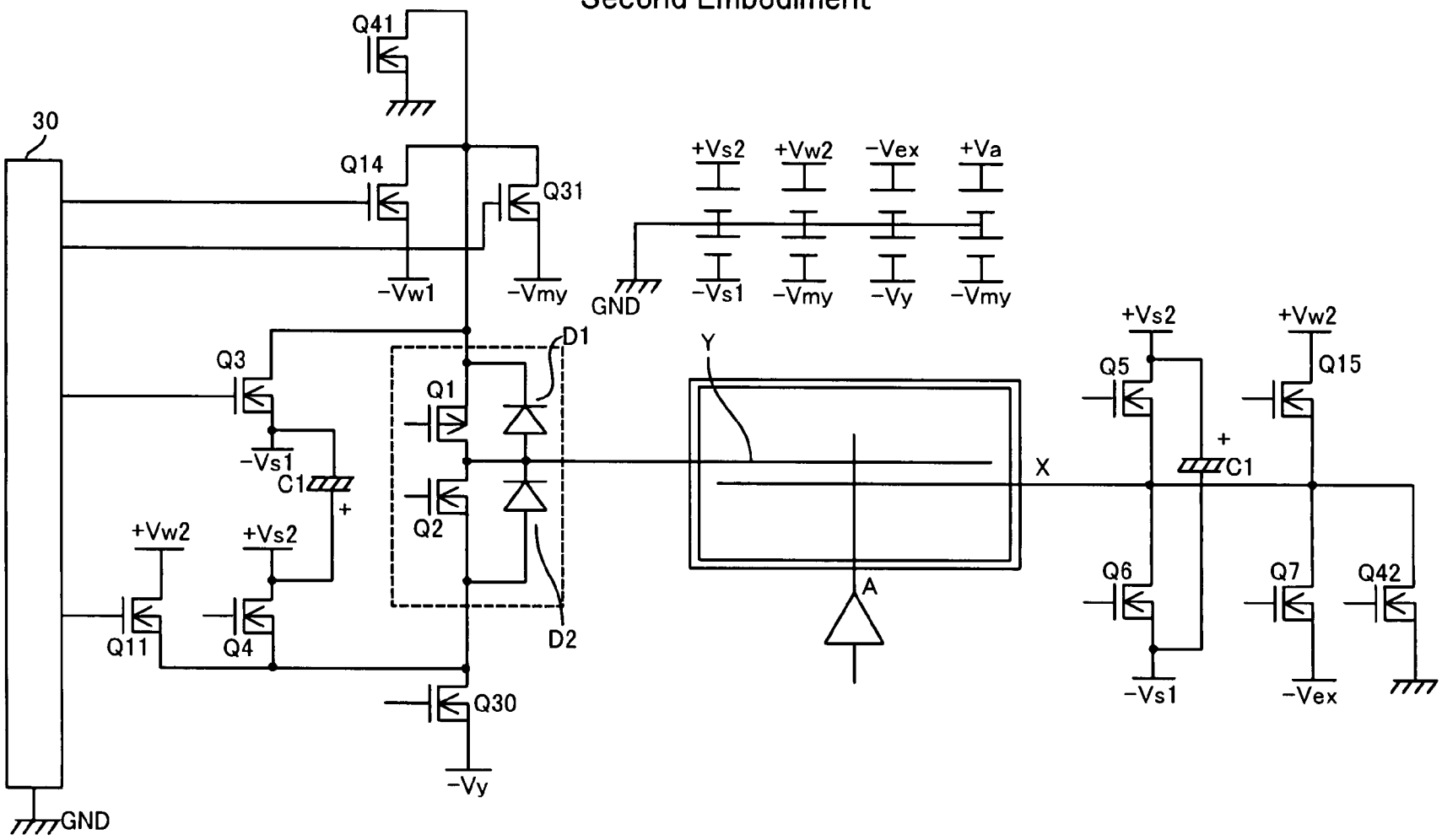
FIG. 11 is a diagram illustrating the drive circuit in the second embodiment.

FIG. 10 is a diagram illustrating the drive waveform in the second embodiment, while FIG. 11 is a diagram illustrating the drive circuit in the second embodiment. The same reference numbers will be used to refer to those components that correspond to the first embodiment. This second embodiment involves the use of sustaining pulses SUSP or full-write pulses WP with reversed polarity from that in the first embodiment. Also, the write pulses are supplied to the Y electrodes during full-write. Finally, positive power sources +Vw2 and +Vs2 are used as the reference power sources.

With this embodiment, the reference voltage in the sustaining period is set to the power source +Vs2 of positive polarity, and sustaining voltage pulses SUSP of negative polarity whose potential is changed from the level of this power source +Vs2 to the peak voltage −Vs1 is applied to the X and Y electrodes.

The advantage here is that the voltage pulses generated by the discharge have a potential of negative polarity, so the positive ions of the discharge gas accumulate on the Y and X electrode side, which are the sustaining electrodes, during the discharge generation, and electrons accumulate on the address electrode side across from these electrodes. It is therefore possible to avoid the positive ion collisions with the fluorescent material on the address electrode side that occurred in the past. The benefit in this is a longer service life. Also, a write voltage −Vwy of negative polarity is applied to the Y electrodes from the reference voltage +Vw2 of positive polarity in an effort to obtain the same effect in the application of the full-write voltage pulses WP, rather than just the sustaining voltage pulses SUSP.

Third Embodiment

Figure 12:
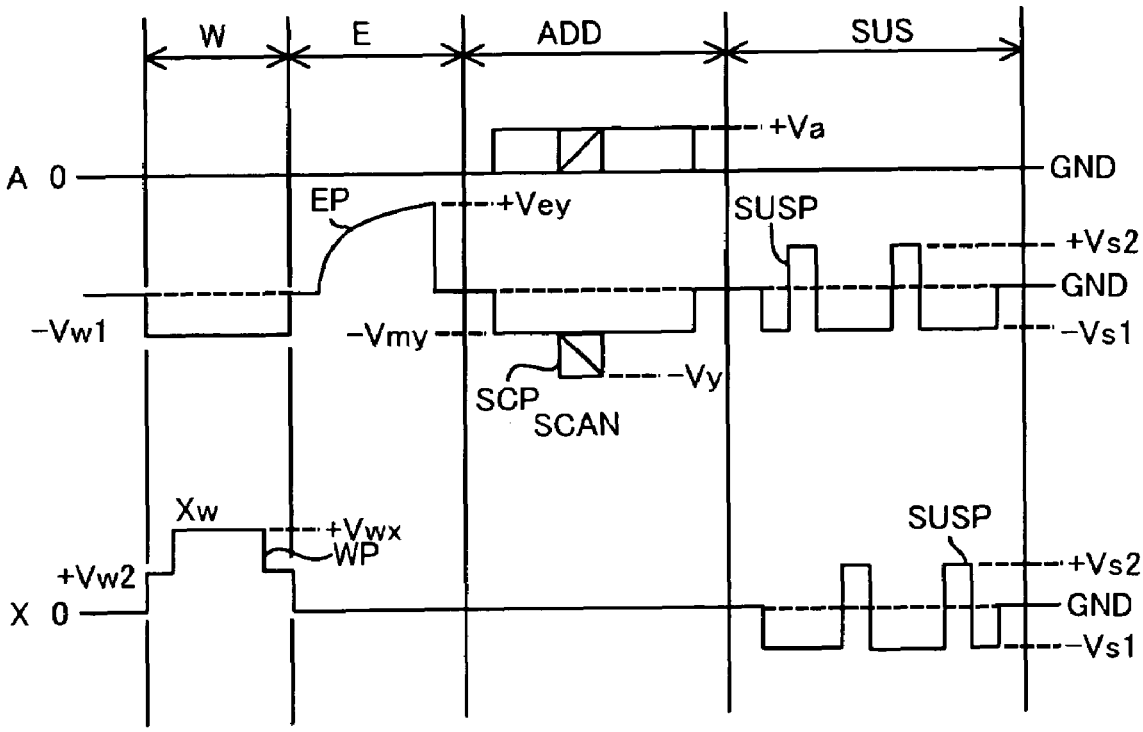
FIG. 12 is a diagram illustrating the drive waveform in the third embodiment.
Figure 13:
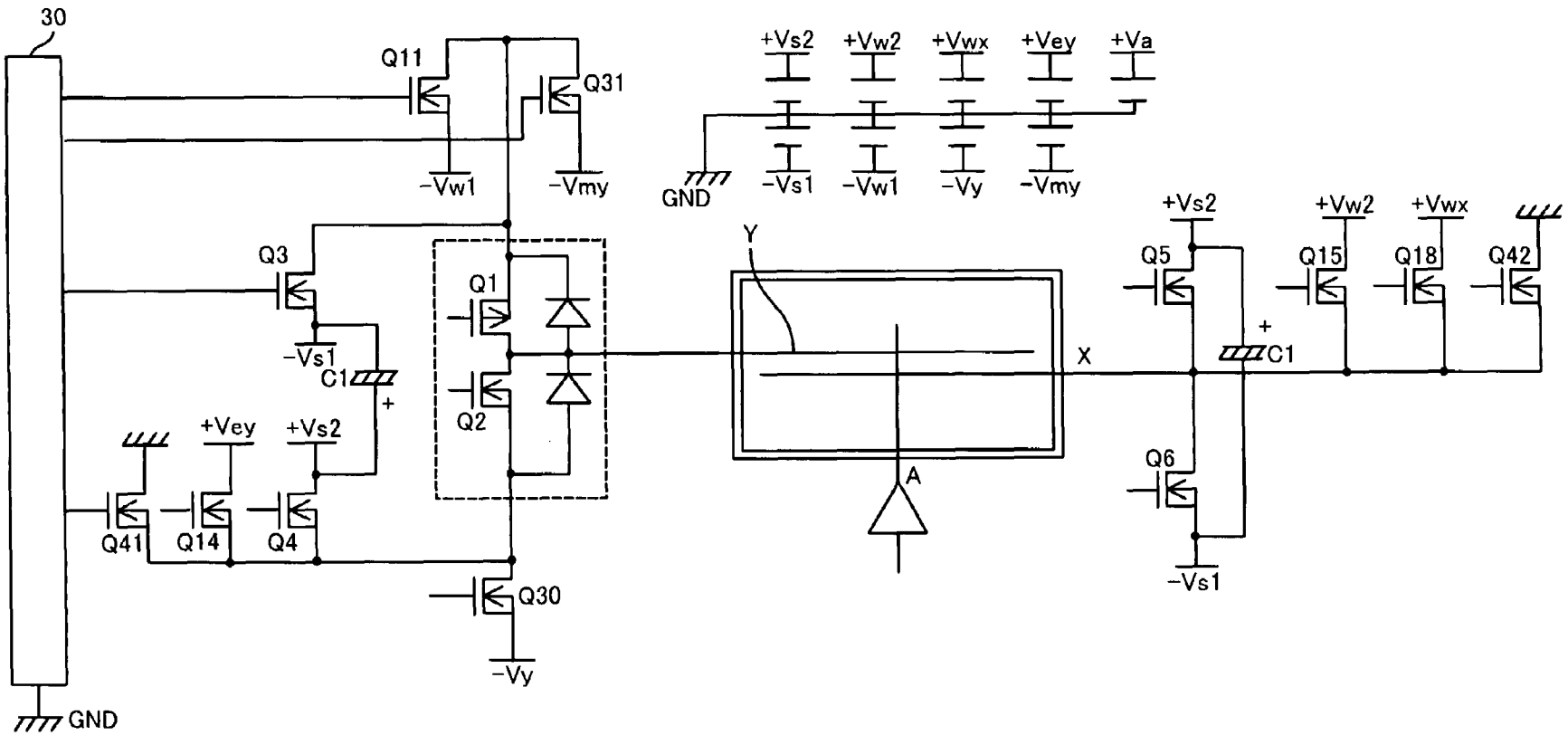
FIG. 13 is a diagram illustrating the drive circuit in the third embodiment.

FIG. 12 is a diagram illustrating the drive waveform in the third embodiment, while FIG. 13 is a diagram illustrating the drive circuit in the third embodiment. In this example, the sustaining period is the same as in the first embodiment (FIG. 8), the X and Y electrodes are changed to the negative reference power source −Vs1, and sustaining pulses SUSP of the positive power source +Vs2 are applied thereto. Meanwhile, the application of the reference voltage during the full-write period is different from that in the first embodiment.

As shown in FIG. 12, at the same time the full-write period W is entered, separate reference voltages are applied, with the reference voltage −Vw1 of negative polarity to the Y electrodes and the reference voltage +Vw2 of positive polarity to the X electrodes. Thus using separate reference voltages allows the voltage between the electrodes required for a write operation to be added to the reference voltage, so it is possible to reduce voltage amplitude during the application of the power source +Vwx from the reference voltage +Vw2 as the write pulse WP. This allows the various voltage changes to be reduced, permitting better reduction of noise such as higher harmonics.

As shown in the drive circuit in FIG. 13, the transistor Q15 is conductive during full-write to change the X electrodes first to the reference power source +Vw2, and then the transistor Q18 is conductive to change the X electrodes to the power source +Vwx. The drive circuit on the Y electrode side is configured the same as in the first embodiment.

Fourth Embodiment

Figure 14:
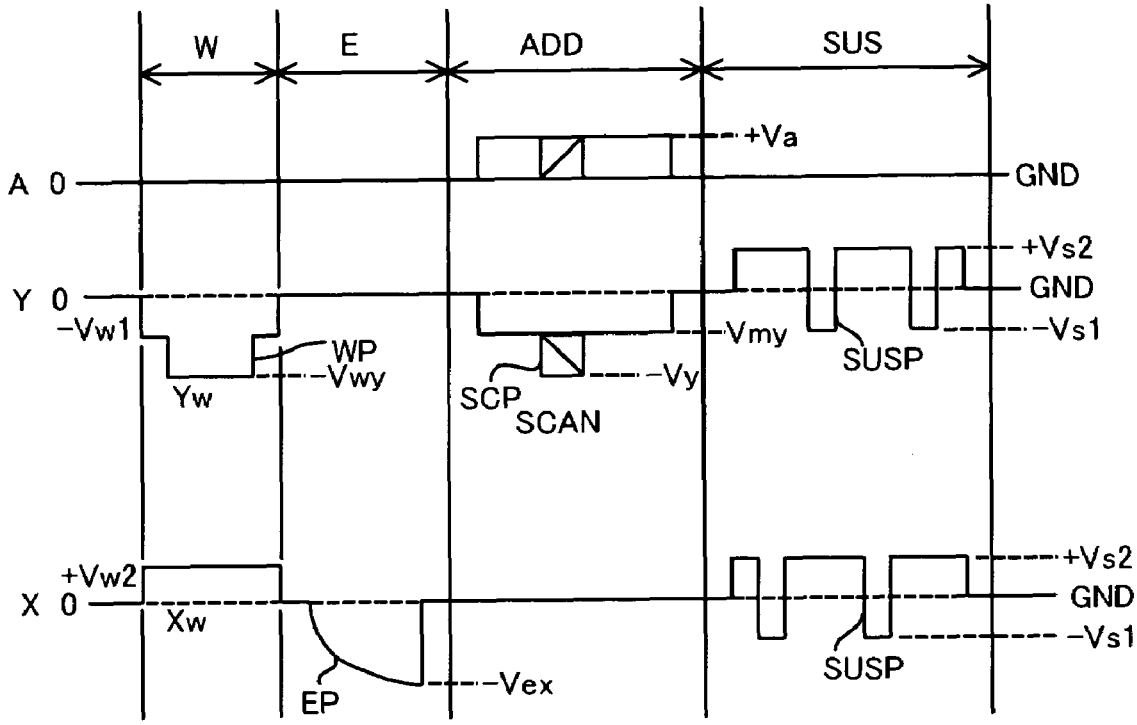
FIG. 14 is a diagram illustrating the drive waveform in the fourth embodiment.
Figure 15:
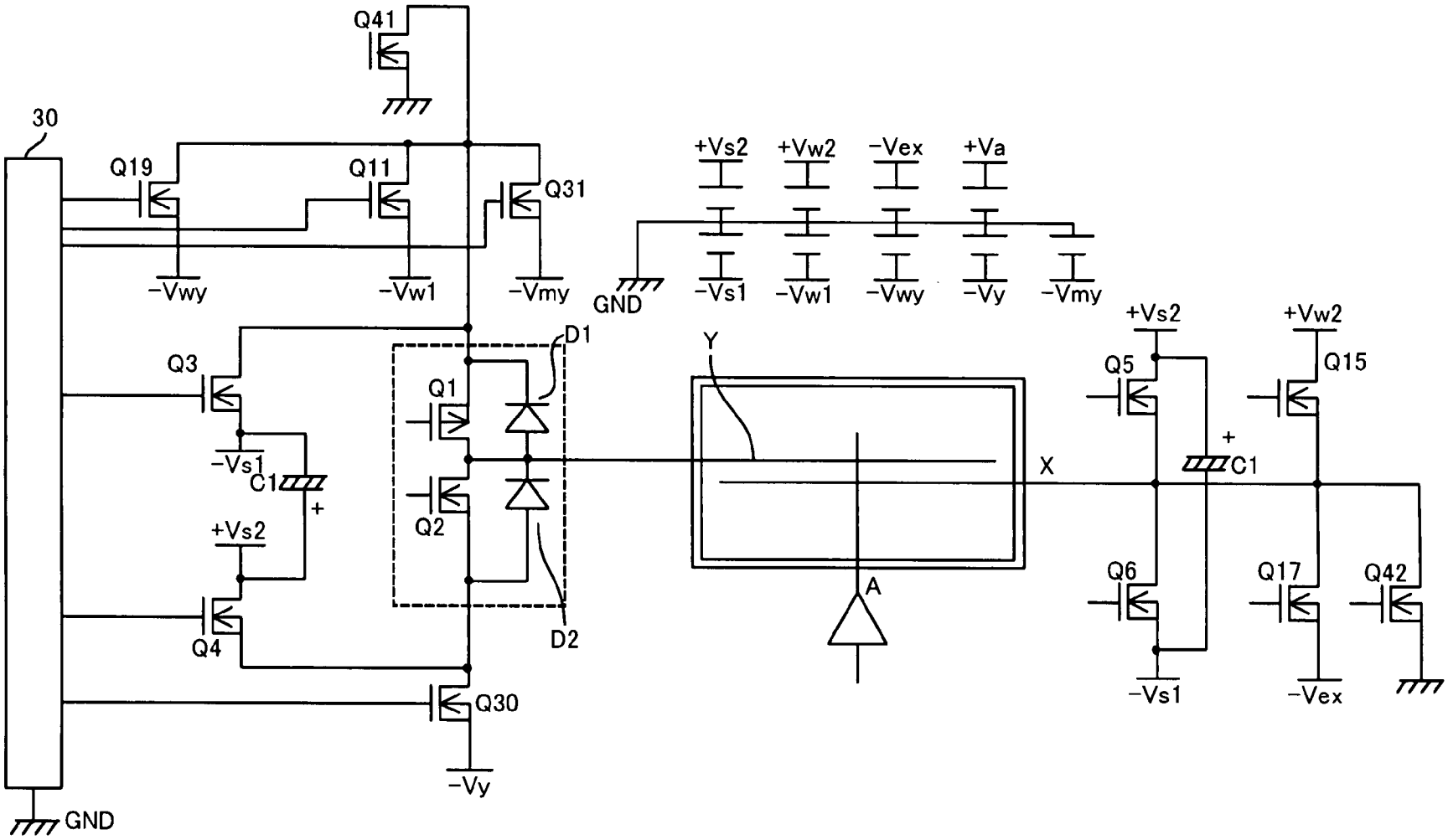
FIG. 15 is a diagram illustrating the drive circuit in the fourth embodiment.

FIG. 14 is a diagram illustrating the drive waveform in the fourth embodiment, while FIG. 15 is a diagram illustrating the drive circuit in the fourth embodiment. In this example, the sustaining period is the same as in the second embodiment (FIG. 10), the X and Y electrodes are changed to the positive reference power source +Vs2, and sustaining pulses SUSP of the negative power source −Vs1 are applied thereto. Meanwhile, the application of the reference voltage during the full-write period is different from that in the second embodiment, and is of the opposite polarity as in the third embodiment (FIG. 12).

In this example, the drive during the full-write period is such that separate reference voltages are applied, with the reference voltage −Vw1 of negative polarity to the Y electrodes and the reference voltage +Vw2 of positive polarity to the X electrodes, and the power source −Vwy is applied using the write voltage required for a write operation as the write pulses WP from the Y electrode side. Since reference voltage of opposite polarity is shared as part of the write voltage, the drive voltage of the various electrodes is lower, allowing noise such as higher harmonics to be decreased.

In the drive circuit of FIG. 15, the drive circuit on the Y electrode side is provided with a transistor Q11 that applies a negative reference power source −Vw1, and a transistor Q19 that applies a negative power source −Vwy for writing. The drive circuit on the X electrode side is the same as in the second embodiment (FIG. 11).

Fifth Embodiment

Figure 16:
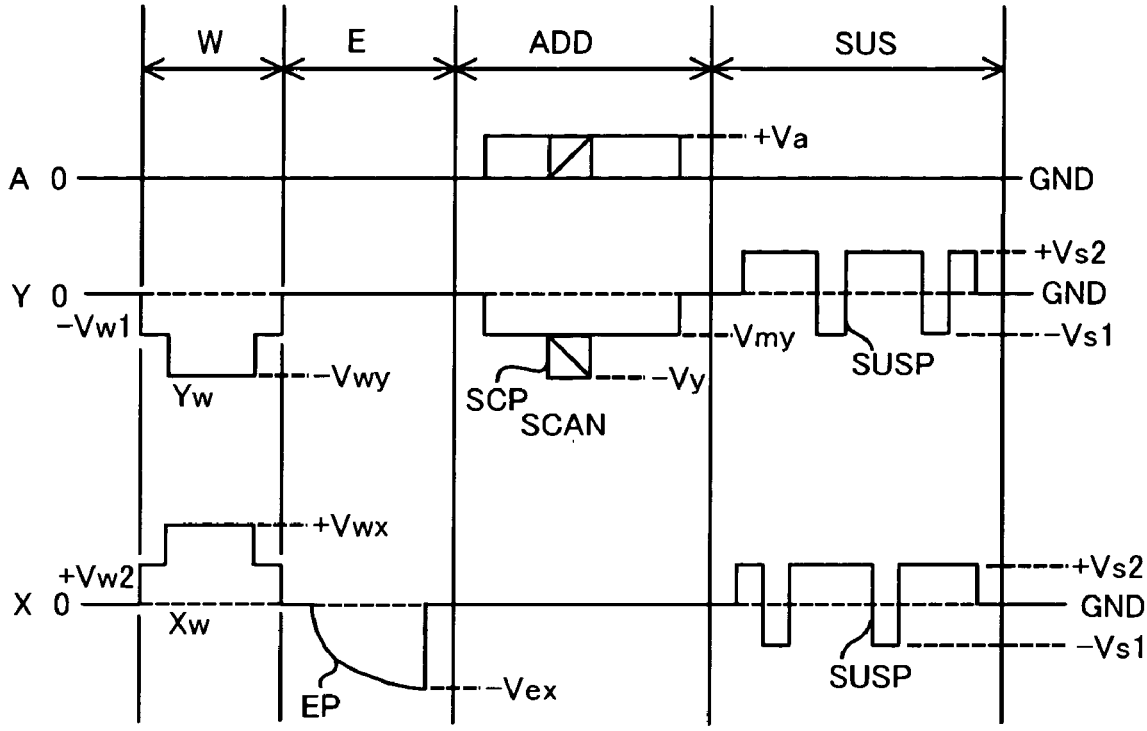
FIG. 16 is a diagram illustrating the drive waveform in the fifth embodiment.
Figure 17:
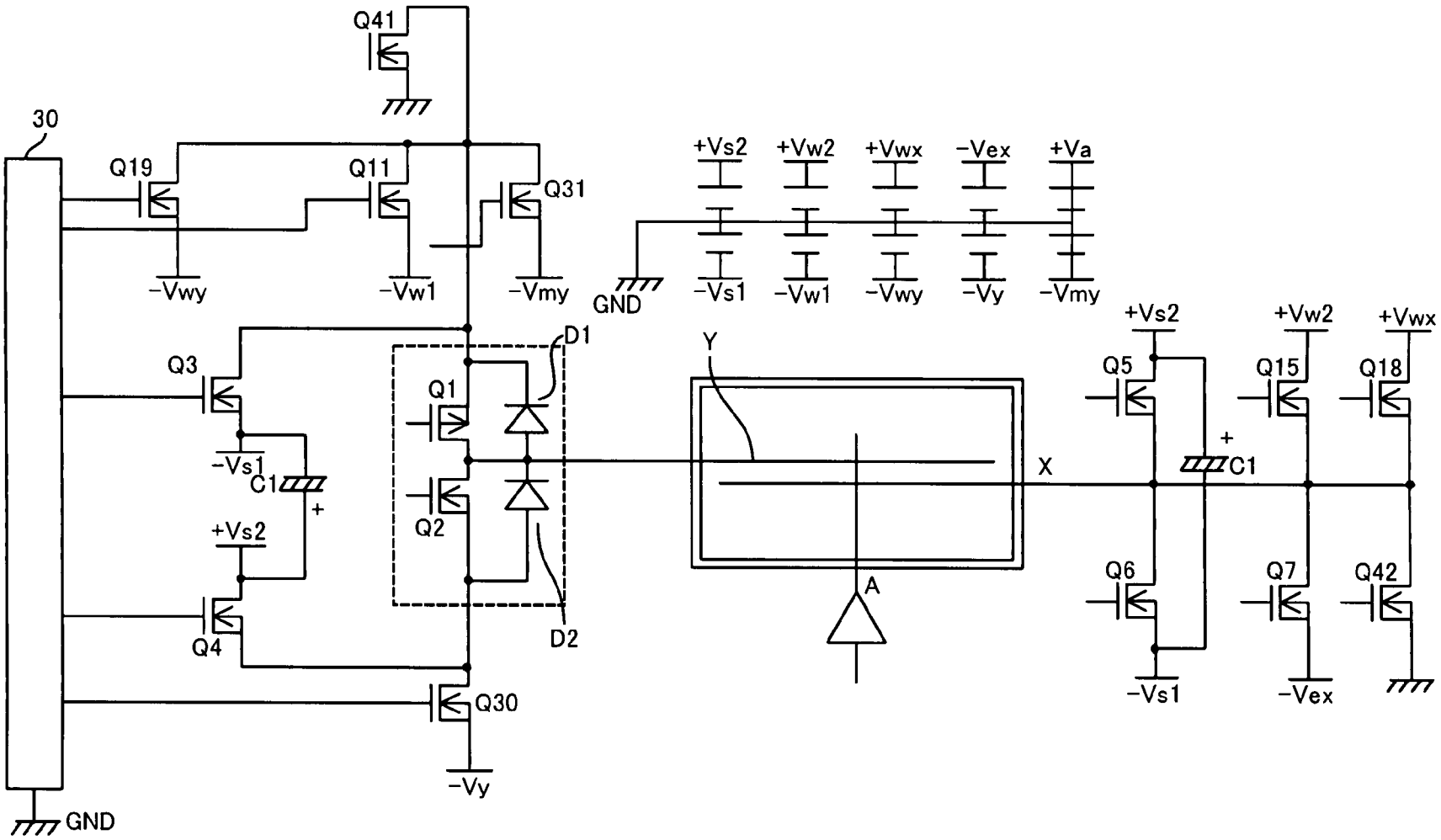
FIG. 17 is a diagram illustrating the drive circuit in the fifth embodiment.

FIG. 16 is a diagram illustrating the drive waveform in the fifth embodiment, while FIG. 17 is a diagram illustrating the drive circuit in the fifth embodiment. In this example, the sustaining period is the same as in the second embodiment (FIG. 10) and the fourth embodiment (FIG. 14), the X and Y electrodes are changed to the positive reference power source +Vs2, and sustaining pulses SUSP of the negative power source −Vs1 are applied thereto. Meanwhile, the application of the reference voltage during the full-write period, and the application of the write voltage, are performed by pulses that are both of opposite polarity with respect to the X and Y electrodes.

In the first to fourth embodiments, the write pulses were only applied to either the Y electrodes or the X electrodes, but in this embodiment, writing is performed with the combined voltage from both of these electrodes. Specifically, along with the start of the full-write period, the reference voltage −Vw1 of negative polarity is applied to the Y electrodes and the reference voltage +Vw2 of positive polarity to the X electrodes, after which write pulses Yw of negative polarity and of the level of the power source −Vwy are applied from the Y electrode side, while write pulses Xw of positive polarity and of the level of the power source +Vwx is applied from the X electrode side, and a write discharge is generated by this combined voltage. With this method, the amplitude of the voltage pulses variously applied to the two electrodes can be reduced by nearly half, and induced noise can also be kept low. As shown in FIG. 17, transistors Q15 and Q18 are provided to the drive circuit of the X electrodes, and transistors Q11 and Q19 are provided to the drive circuit of the Y electrodes, making possible the application of the above-mentioned full-write pulses.

Sixth Embodiment

Figure 18:
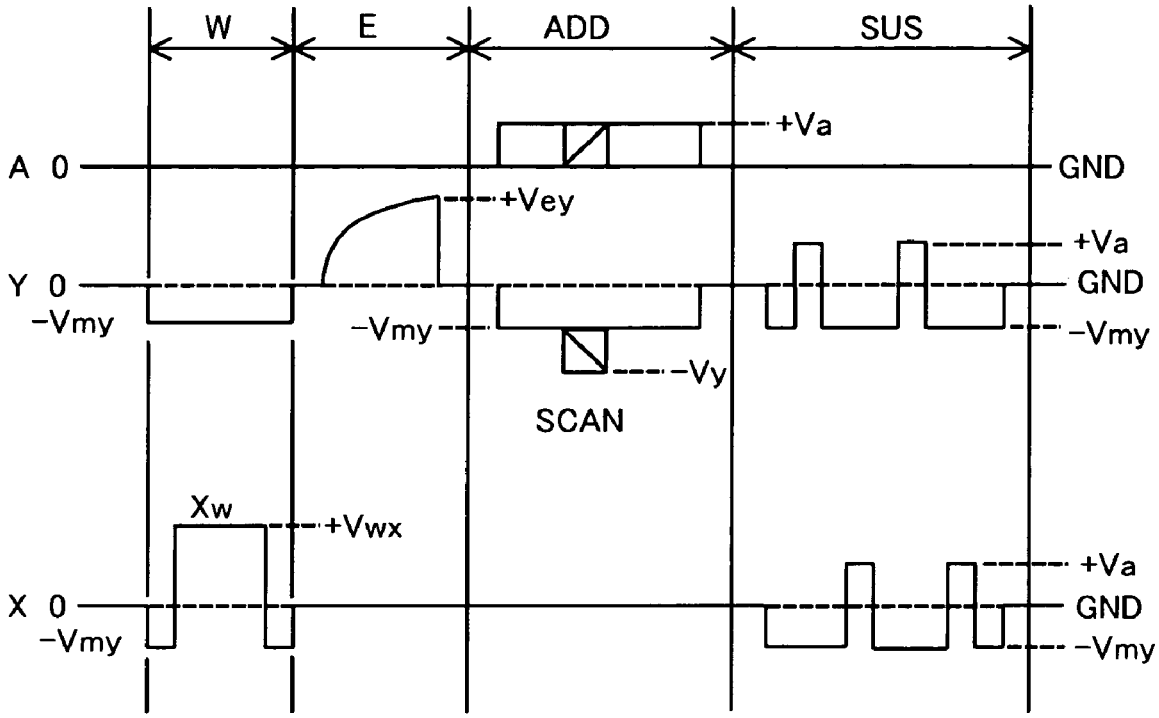
FIG. 18 is a diagram illustrating the drive waveform in the sixth embodiment.
Figure 19:
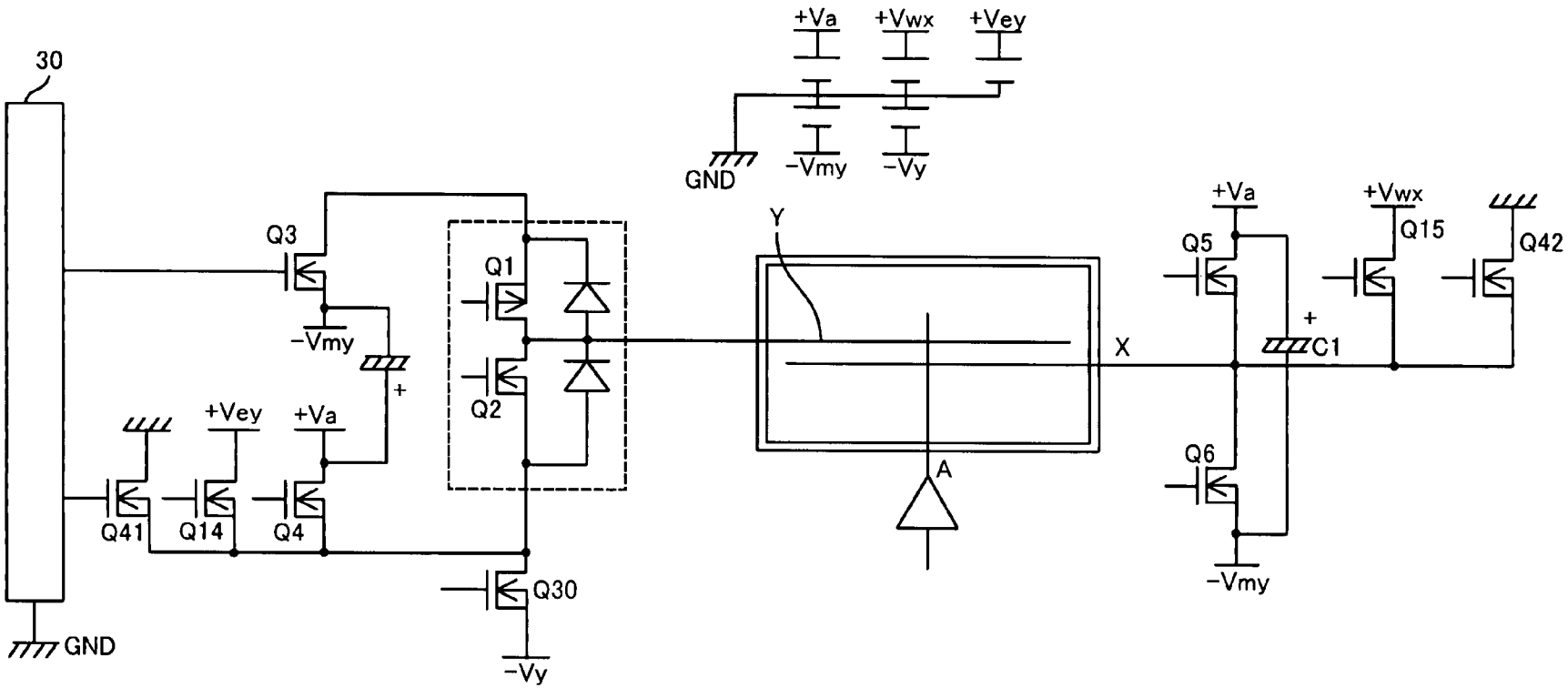
FIG. 19 is a diagram illustrating the drive circuit in the sixth embodiment.

FIG. 18 is a diagram illustrating the drive waveform in the sixth embodiment, while FIG. 19 is a diagram illustrating the drive circuit in the sixth embodiment. In this example, the sustaining period and the full-write period are both configured with the same waveforms as in the first embodiment. However, a power source with a similar voltage level is shared in a plurality of drive-use power sources, reducing the types thereof, making the drive circuit more compact, and lowering cost. Specifically, the sustaining voltage of positive polarity is shared with the address voltage Va on the address side, and the sustaining voltage of negative polarity is shared with the Y electrode reference voltage −Vmy in the address period and with the reference voltage −Vmy in the full-write period. As a result, only five types of power source are required, comprising the above-mentioned two types of common power source Va and −Vmy, and three types of special-purpose power source, the erase power source +Vey on the Y electrode side, the write power source +Vwx on the X electrode side, and scanning-use power source −Vy on the Y electrode side. This makes the configuration simpler than in the first embodiment.

In relation to this, as shown in FIG. 19, the number of drive transistors in the drive circuit can also be reduced from that in the first embodiment. Therefore, the overall product is much more compact and inexpensive.

This sharing of the drive power sources in the sixth embodiment can also be accomplished in the second to fifth embodiments. In this case, power sources with the same polarity and similar potential can be shared, allowing the power sources and the drive circuit to be simplified.

Seventh Embodiment

Figure 20:
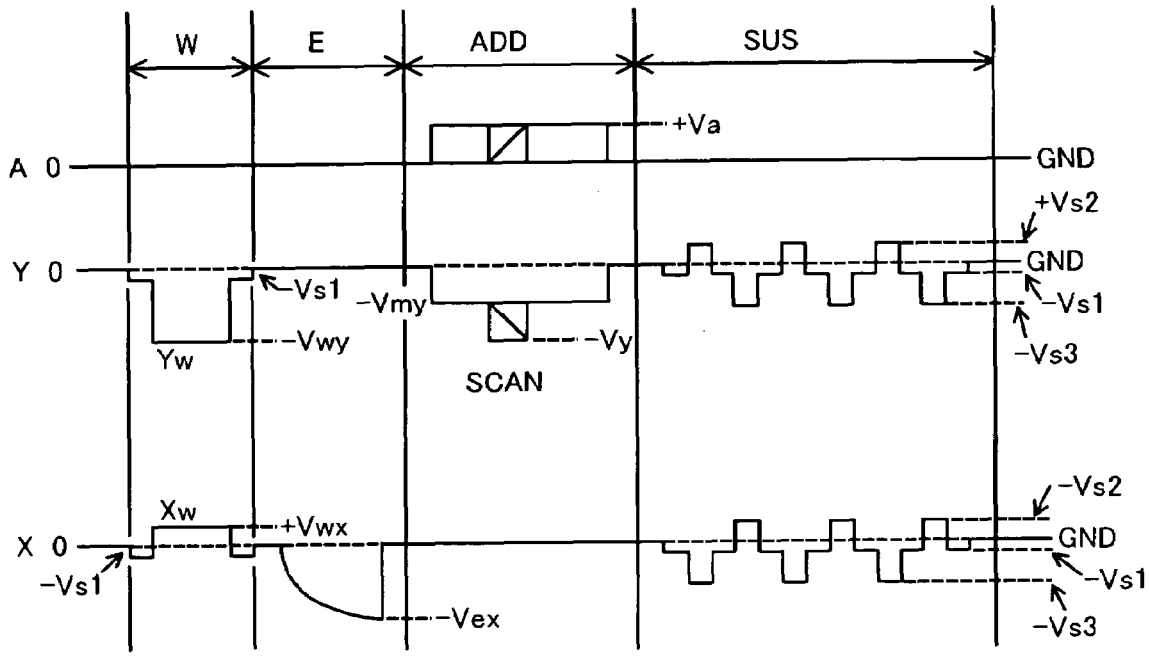
FIG. 20 is a diagram illustrating the drive waveform in the seventh embodiment.
Figure 21:
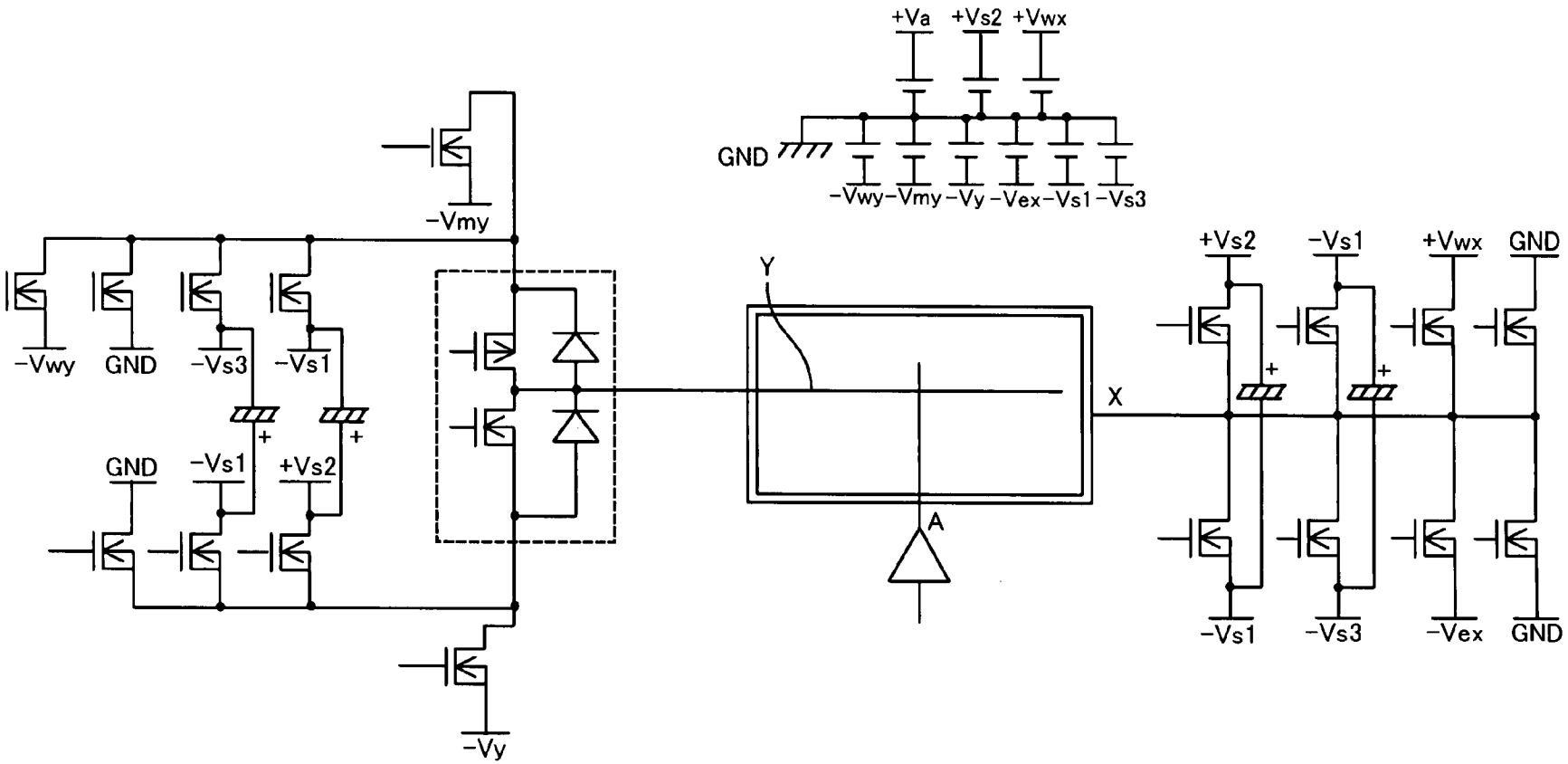
FIG. 21 is a diagram illustrating the drive circuit in the seventh embodiment.

FIG. 20 is a diagram illustrating the drive waveform in the seventh embodiment, while FIG. 21 is a diagram illustrating the drive circuit in the seventh embodiment. This example utilizes the third drive method illustrated in FIG. 6, and involves the driving of the sustaining discharge and full-write X and Y electrodes.

First, in the sustaining discharge period SUS, as shown in FIG. 20, the two electrodes are driven from the ground potential to the negative reference power source −Vs1. One of the electrodes is driven from this state to the more negative power source −Vs3, and the other electrode is simultaneously driven to the positive power source +Vs2. As a result, as was described for the third drive method, the combination of sustaining pulses applied to the various electrodes results in the voltage required for sustaining discharge being applied between the two electrodes. This discharge current does not, however, flow to the ground power source GND.

Similarly, in the full-write period, as shown in FIG. 20, the two electrodes are driven from the ground potential to the negative reference power source −Vs1. The X electrodes are driven to the positive power source +Vwx to apply write pulses Xw, and the Y electrodes are driven to the negative power source −Vwy to apply the write pulses Yw of the opposite polarity. The combination of these pulses of opposite polarity results in the application of a sufficiently large write voltage between the two electrodes, and the generation of a full-panel discharge. Here again, the discharge current does not flow to the ground power source. In the full-write period, the pulses applied to the various electrodes are also small, so accompanying noise such as higher harmonics can be reduced.

FIG. 21 shows the drive transistors and power sources used to perform the above-mentioned electrode drive. These drive transistors are controlled by a control circuit so as to realize the drive waveforms of FIG. 20.

Eighth Embodiment

Figure 22:
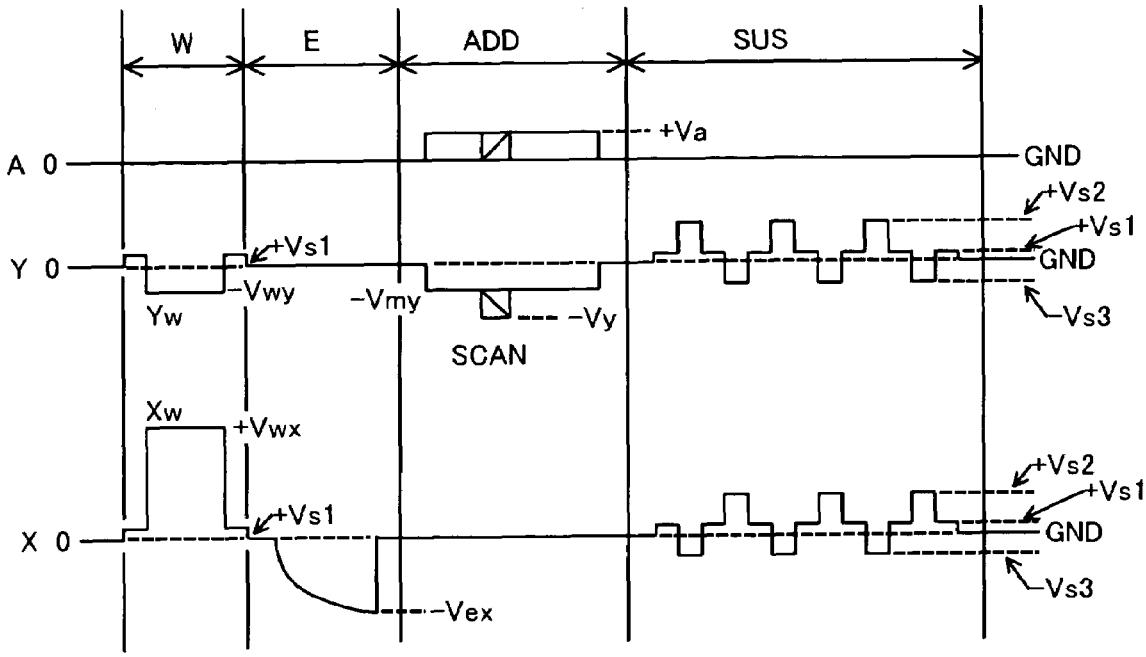
FIG. 22 is a diagram illustrating the drive waveform in the eighth embodiment.
Figure 23:
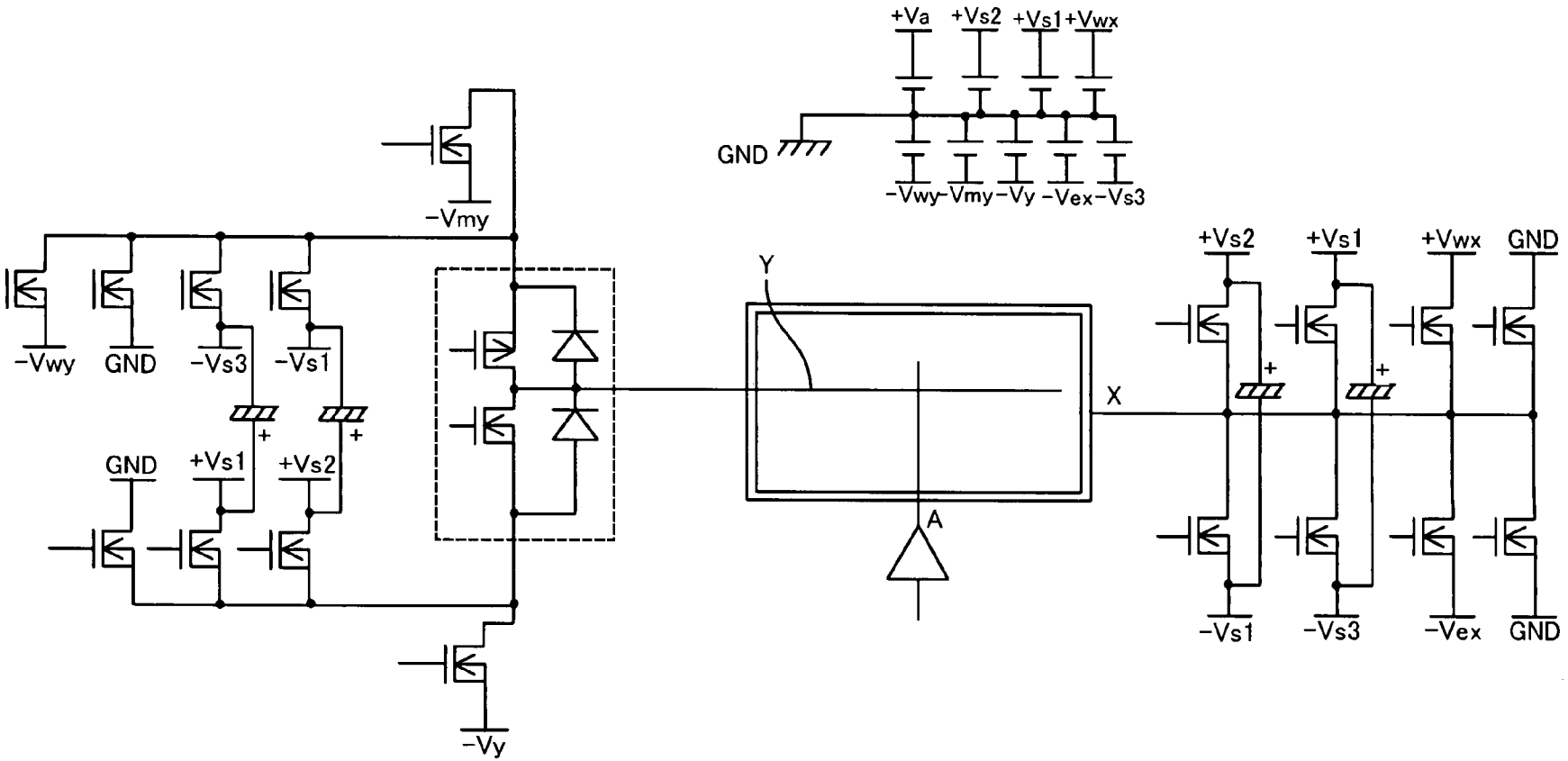
FIG. 23 is a diagram illustrating the drive circuit in the eighth embodiment.

FIG. 22 is a diagram illustrating the drive waveform in the eighth embodiment, while FIG. 23 is a diagram illustrating the drive circuit in the eighth embodiment. This example utilizes the fourth drive method illustrated in FIG. 7, and involves the driving of the sustaining discharge and full-write X and Y electrodes. Specifically, this drive method has the opposite polarity as in the seventh embodiment.

First, in the sustaining discharge period SUS, as shown in FIG. 22, the two electrodes are driven from the ground potential to the positive reference power source +Vs1. One of the electrodes is driven from this state to the more positive power source +Vs2, and the other electrode is simultaneously driven to the negative power source −Vs3. As a result, as was described for the fourth drive method, the combination of sustaining pulses applied to the various electrodes results in the voltage required for sustaining discharge being applied between the two electrodes. This discharge current does not, however, flow to the ground power source GND.

Similarly, in the full-write period, as shown in FIG. 22, the two electrodes are driven from the ground potential to the positive reference power source +Vs1. The X electrodes are driven to the positive power source +Vwx to apply write pulses Xw, and the Y electrodes are driven to the negative power source −Vwy to apply the write pulses Yw of the opposite polarity. The combination of these pulses of opposite polarity results in the application of a sufficiently large write voltage between the two electrodes, and the generation of a full-panel discharge. Here again, the discharge current does not flow to the ground power source. In the full-write period, the pulses applied to the various electrodes are also small, so accompanying noise such as higher harmonics can be reduced.

FIG. 23 shows the drive transistors and power sources used to perform the above-mentioned electrode drive. These drive transistors are controlled by a control circuit so as to realize the drive waveforms of FIG. 22.

Embodiments of the present invention were described above using a three-electrode type of surface discharge AC-PDP as an example, but within the scope of the present invention, it can be similarly applied to conventional opposing discharge type AC-PDP device as well.

With the present invention, it is possible to prevent the large peaked current that accompanies charge and discharge for capacitance or gas discharge from flowing to the ground power source line by driving the electrodes to a separate power source from a power source that is different from the ground power source when drive pulses are applied. Therefore, noise to the ground potential is prevented, and problems such as the attendant malfunctions, distortion of the drive waveform, interference with electromagnetic radiation, and so on can be solved.

Also, the voltage can be kept low between address electrodes and sustaining electrodes consisting of X and Y electrodes during gas discharge generation by maintaining the address electrodes at an intermediate potential with respect to the amplitude of the discharge pulses. Therefore, charges can be prevented from accumulating excessively on the dielectric layer surfaces on the address electrode side, and the accompanying erroneous discharges can be prevented.

What is claimed is:

1. A driving device of a plasma display panel having a plurality of first and second electrodes spaced apart from one another to form pairs and a plurality of cells formed between the first and second electrodes, and displaying according to the plural cells by applying drive voltages to said first and second electrodes, comprising:

a first power supply having negative polarity;

a second power supply having positive polarity;

a scan driver connected to the plural first electrodes respectively;

a first electrode common driver connected to the scan driver commonly; and a second electrode common driver connected to the plural second electrodes commonly;

wherein at a first timing for lightening the plural cells, drive current flows through a connection route of the second power supply, the first electrode common driver, the scan driver, the first electrode, the cell, the second electrode, the second electrode common driver and the first power supply, and at a second timing for lightening the plural cells, drive current flows through a connection route of the second power supply, the second electrode common driver, the second electrode, the cell, the first electrode, the scan driver, the first electrode common driver and the first power supply.

2. The driving device of a plasma display panel according to claim 1, wherein driving operations at the first timing and the second timing are performed alternately, and at transitions between the first and second timings, a connection route of the first power supply, the first electrode common driver, the scan driver, the first electrode, the cell, the second electrode, the second electrode common driver and the first power supply is formed so that the first power supply having negative polarity is commonly applied to the first and second electrodes.

3. The driving device of a plasma display panel according to claim 1, wherein driving operations at the first timing and the second timing are performed alternately, and at transitions between the first and second timings, a connection route of the second power supply, the first electrode common driver, the scan driver, the first electrode, the cell, the second electrode, the second electrode common driver and the second power supply is formed so that the second power supply having positive polarity is commonly applied to the first and second electrodes.

4. The driving device of a plasma display panel according to claim 1, further comprising:

a third power supply having potential between the first and second power supplies, wherein driving operations at the first timing and the second timing are performed alternately, and at transitions between the first and second timings, a connection route of the third power supply, the first electrode common driver, the scan driver, the first electrode, the cell, the second electrode, the second electrode common driver and the third power supply is formed so that the third power supply is commonly applied to the first and second electrodes.

5. The driving device of a plasma display panel according to claim 4, wherein said third power supply has a voltage having negative polarity.

6. The driving device of a plasma display panel according to claim 4, wherein said third power supply has a voltage having positive polarity.

7. The driving device of a plasma display panel according to claim 4, further comprising:

a plurality of third electrodes crossing the plural first and second electrodes; and an address driver connected to the plural third electrodes respectively, wherein said address driver applies a ground potential to the plural third electrodes and maintains the plural third electrodes at the ground potential during the first and second timings.

8. The driving device of a plasma display panel according to claim 4, wherein a large capacitance condenser is connected between terminals of the first power supply and the second power supply.

9. A driving device of plasma display panel according to claim 1, further comprising:

a plurality of third electrodes crossing the plural first and second electrodes and an address driver connected to the plural third electrodes respectively, wherein said address driver applies a ground potential to the plural third electrodes and maintains the plural third electrodes at the ground potential during the first and second timings.

10. A driving device of plasma display panel according to claim 1, wherein, a large capacitance condenser is connected between terminals of the first power supply and the second power supply.

* * * * *